US011867010B2

(12) United States Patent
Pye

(10) Patent No.: US 11,867,010 B2
(45) Date of Patent: Jan. 9, 2024

(54) DEPLOYING A LINER IN A WELLBORE

(71) Applicant: Saudi Arabian Oil Company, Dhahran (SA)

(72) Inventor: Richard Mark Pye, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 9 days.

(21) Appl. No.: 17/536,775

(22) Filed: Nov. 29, 2021

(65) Prior Publication Data

US 2023/0167696 A1 Jun. 1, 2023

(51) Int. Cl.

| | |
|---|---|
| ***E21B 23/01*** | (2006.01) |
| ***E21B 33/10*** | (2006.01) |
| ***E21B 43/10*** | (2006.01) |
| ***E21B 21/00*** | (2006.01) |

(52) U.S. Cl.
CPC ..... *E21B 23/01* (2013.01); *E21B 21/003* (2013.01); *E21B 33/10* (2013.01); *E21B 43/103* (2013.01)

(58) Field of Classification Search
CPC .... E21B 43/103; E21B 43/105; E21B 21/003; E21B 23/01; E21B 33/10; E21B 33/1243; E21B 33/1246; E21B 33/127
See application file for complete search history.

(56) References Cited

U.S. PATENT DOCUMENTS

| | | | |
|---|---|---|---|
| 2,927,775 A | 3/1960 | Hildebrandt | |
| 3,422,631 A | 1/1969 | Silverman | |
| 3,578,078 A * | 5/1971 | Shillander | E21B 49/087 175/321 |
| 4,191,493 A | 3/1980 | Hansson | |
| 5,388,648 A | 2/1995 | Jordan | |

(Continued)

FOREIGN PATENT DOCUMENTS

| | | |
|---|---|---|
| EP | 2770159 | 8/2014 |
| GB | 2357305 | 6/2001 |

(Continued)

OTHER PUBLICATIONS

PCT International Search Report and Written Opinion in International Appln. No. PCT/US2018/044095, dated Nov. 29, 2018, 12 pages.

(Continued)

*Primary Examiner* — D. Andrews
*Assistant Examiner* — Ronald R Runyan
(74) *Attorney, Agent, or Firm* — Fish & Richardson P.C.

(57) ABSTRACT

A downhole liner delivery tool includes a housing with a flow path; a detachable nose assembly coupled to the housing and fluidly coupled to the flow path and including one or more retractable grips; a flexible wellbore liner including a first end coupled to the detachable nose assembly and a second end coupled within the housing and stored within the flow path of the housing; a seat formed in the flow path and configured to receive a member dropped in a wellbore to increase a fluid pressure of a fluid resin pumped through the flow path to anchor the one or more retractable grips to a wellbore wall and detach the detachable nose assembly from the housing, the fluid resin further pumped through the flow path to deploy the flexible wellbore liner from the housing and seal the flexible wellbore liner against the wellbore wall.

24 Claims, 17 Drawing Sheets

(56) References Cited

U.S. PATENT DOCUMENTS

| | | | | |
|---|---|---|---|---|
| 5,501,248 | A | 3/1996 | Kiest | |
| 5,853,049 | A | 12/1998 | Keller | |
| 6,012,526 | A | 1/2000 | Jennings et al. | |
| 8,567,491 | B2 | 10/2013 | Lurie | |
| 2003/0015247 | A1* | 1/2003 | Driver | F16L 55/1654 405/184.2 |
| 2006/0130922 | A1 | 6/2006 | Kamiyama et al. | |
| 2009/0178809 | A1 | 7/2009 | Jeffryes et al. | |
| 2011/0120732 | A1 | 5/2011 | Lurie | |
| 2018/0274312 | A1* | 9/2018 | Zhou | E21B 43/08 |
| 2021/0164329 | A1 | 6/2021 | Affleck | |

FOREIGN PATENT DOCUMENTS

| | | | | |
|---|---|---|---|---|
| WO | WO 03042495 | | 5/2003 | |
| WO | WO-2019023413 | A1 * | 1/2019 | E21B 33/128 |
| WO | 2019027830 | | 2/2019 | |

OTHER PUBLICATIONS

PCT International Search Report and Written Opinion in International Appln. No. PCT/US2022/050560, dated Feb. 22, 2023, 13 pages.

* cited by examiner

DEPLOYING A LINER IN A WELLBORE

TECHNICAL FIELD

The present disclosure relates to apparatus, systems, and methods for deploying a liner in a wellbore.

BACKGROUND

Drilling fluid loss mitigation and consequence can be temporally and economically inefficient. When unacceptable drilling fluid losses are encountered, conventional lost circulation technologies can be deployed into the drilling fluid from a terranean surface. The drilling fluid, which includes loss mitigation chemicals, can be pumped downhole as part of the standard well circulation system. The modified drilling fluid passes through a bottom hole assembly (BHA), including a drill bit, or bypasses the BHA through a circulation port and can be designed to plug (for example, pressure seal) the exposed formation at a location in the wellbore in which losses are occurring. Once sealing of the wellbore has occurred and acceptable fluid loss control is established, drilling operations may resume. Conventional lost circulation material (LCM) may seal uniformly shaped formation voids (for example, widths) up to approximately 4-6 millimeters (mm) but struggle with un-uniform and larger voids. Effective sealing is often both challenging and costly. In addition to replacing costly drilling fluid, drilling operations may need to cease in order to take time resolving the fluid losses before continuing to drill into a subterranean zone. Such measures may include pumping increasingly coarse grades of LCM, junk plugs, attempting to cement over the loss point or running casing to place the loss-inducing formation behind steel and squeezing a cement isolating barrier.

SUMMARY

In an example implementation, a downhole liner delivery tool includes a housing configured to couple to a tubular work string, where the housing includes a flow path; a detachable nose assembly coupled to a downhole end of the housing and fluidly coupled to the flow path, where the detachable nose assembly includes one or more retractable grips positioned at an external surface of the detachable nose assembly; a flexible wellbore liner including a first end coupled to the detachable nose assembly and a second end coupled within the housing, the flexible wellbore liner stored within the flow path of the housing; a seat formed in the flow path and configured to receive a member dropped in a wellbore from a terranean surface to increase a fluid pressure of a fluid resin pumped through the flow path to anchor the one or more retractable grips to a wellbore wall and detach the detachable nose assembly from the housing, the fluid resin further pumped through the flow path to deploy the flexible wellbore liner from the housing and seal the flexible wellbore liner against the wellbore wall.

An aspect combinable with the example implementation further includes a flow crossover sub-assembly positioned in the housing and including one or more ports fluidly coupled to the wellbore through the housing in a first position of the flow crossover sub-assembly to circulate the fluid resin from the flow path to the wellbore In another aspect combinable with any of the previous aspects, the flow crossover sub-assembly is configured to move from the first position to a second position based on breaking one or more shear pins that couples the flow crossover sub-assembly to the housing by the fluid pressure to fluidly decouple the one or more ports from the wellbore to circulate the fluid resin to anchor the one or more retractable grips to the wellbore wall.

In another aspect combinable with any of the previous aspects, the housing includes an index pin positioned to ride in a groove formed on an outer surface of the flow crossover sub-assembly during movement of the flow crossover sub-assembly from the first position to the second position.

In another aspect combinable with any of the previous aspects, the groove includes a slot formed to stop movement of the flow crossover sub-assembly at the second position and maintain the flow crossover sub-assembly at the second position.

Another aspect combinable with any of the previous aspects further includes a top liner anchor positioned within the housing and connected to the second end of the flexible wellbore liner configured to release the second end of the flexible wellbore liner subsequent to sealing the flexible wellbore liner against the wellbore.

Another aspect combinable with any of the previous aspects further includes a float housing coupled to the top liner anchor and moveable, based on an uphole movement of the tubular work string, within the housing to deploy the flexible wellbore liner from the housing.

In another aspect combinable with any of the previous aspects, the top liner anchor is configured to socket into a disengagement ring within the housing to direct the fluid resin pumped through the flow path to an inner volume of the deployed flexible wellbore liner.

In another aspect combinable with any of the previous aspects, the float housing includes a float configured to seal fluid resin within the inner volume of the deployed flexible wellbore liner.

In another aspect combinable with any of the previous aspects, the top liner anchor, the float housing, the disengagement ring, and the float are configured to detach from the housing based on rotation of the tubular work string.

In another aspect combinable with any of the previous aspects, the detachable nose assembly includes a nose body that encloses a shuttle and a snap ring that at least partially encircles an end of the shuttle.

In another aspect combinable with any of the previous aspects, the shuttle is configured to move within the nose body based on the fluid pressure to urge the snap ring into a groove formed on an inner surface of the nose body to hold the one or more retractable grips anchored to the wellbore wall.

Another aspect combinable with any of the previous aspects further includes at least one stabilizer mounted on an outer surface of the housing and configured to centralize the housing in the wellbore.

In another example implementation, a method for installing a liner in a wellbore includes running a downhole liner delivery tool on a tubular work string into a wellbore to a particular position adjacent a subterranean formation. The downhole liner delivery tool includes a housing coupled to the tubular work string, where the housing includes a flow path, a detachable nose assembly coupled to a downhole end of the housing and fluidly coupled to the flow path, the detachable nose assembly including one or more retractable grips positioned at an external surface of the detachable nose assembly, and a flexible wellbore liner including a first end coupled to the detachable nose assembly and a second end coupled within the housing, the flexible wellbore liner stored within the flow path of the housing. The method further includes circulating a fluid resin at a fluid pressure from the terranean surface, into the tubular work string, and into the flow path; dropping a member within the fluid resin to land on a seat formed in the flow path to increase the fluid pressure of the fluid resin pumped through the flow path; based on the increased fluid pressure, anchoring the one or more retractable grips to a wellbore wall and detaching the detachable nose assembly from the housing; and further circulating the fluid resin through the flow path to deploy the flexible wellbore liner from the housing and seal the flexible wellbore liner against the wellbore wall.

An aspect combinable with the example implementation further includes circulating the fluid resin through one or more ports of a flow crossover sub-assembly positioned in the housing and into the wellbore through the housing while the flow crossover sub-assembly is in a first position; based on the fluid pressure, breaking one or more shear pins that couples the flow crossover sub-assembly to the housing to move the flow crossover sub-assembly from the first position to a second position to fluidly decouple the one or more ports from the wellbore; and with the flow crossover sub-assembly in the second position, circulating the fluid resin to anchor the one or more retractable grips to the wellbore wall.

In another aspect combinable with any of the previous aspects, the housing includes an index pin.

Another aspect combinable with any of the previous aspects further includes, during movement of the flow crossover sub-assembly from the first position to the second position, causing the flow crossover sub-assembly to rotate based on the index pin riding in a groove formed on an outer surface of the flow crossover sub-assembly; stopping rotation and movement of the flow crossover sub-assembly in the second position based on the index pin positioned in a slot formed in the groove; and maintaining the flow crossover sub-assembly at the second position based on the index pin positioned in the slot formed in the groove.

Another aspect combinable with any of the previous aspects further includes releasing the second end of the flexible wellbore liner from a top liner anchor positioned within the housing subsequent to sealing the flexible wellbore liner against the wellbore.

Another aspect combinable with any of the previous aspects further includes moving the tubular work string uphole; and based on moving the tubular work string uphole, moving a float housing coupled to the top liner anchor within the housing to deploy the flexible wellbore liner from the housing.

In another aspect combinable with any of the previous aspects, the top liner anchor is configured to socket into a disengagement ring within the housing to direct the fluid resin pumped through the flow path to an inner volume of the deployed flexible wellbore liner.

Another aspect combinable with any of the previous aspects further includes sealing fluid resin within the inner volume of the deployed flexible wellbore liner with a float coupled to the float housing.

Another aspect combinable with any of the previous aspects further includes rotating the tubular work string; and based on the rotation, detaching the top liner anchor, the float housing, the disengagement ring, and the float from the housing.

In another aspect combinable with any of the previous aspects, the detachable nose assembly includes a nose body that encloses a shuttle and a snap ring that at least partially encircles an end of the shuttle.

Another aspect combinable with any of the previous aspects further includes moving the shuttle within the nose body based on the fluid pressure to urge the snap ring into a groove formed on an inner surface of the nose body; and with the snap ring in the groove, holding the one or more retractable grips anchored to the wellbore wall.

Another aspect combinable with any of the previous aspects further includes, during movement of the downhole liner delivery tool on the tubular work string within the wellbore, centralizing the housing in the wellbore with at least one stabilizer mounted on an outer surface of the housing.

Implementations according to the present disclosure may include one or more of the following features. For example, implementations of a downhole liner delivery tool can reduce or mitigate a loss of drilling fluids into a subterranean formation. Further, implementations of a downhole liner delivery tool can provide for a more uniform dimension, or gauge, of a wellbore for drilling operations. Further, implementations of a downhole liner delivery tool may reduce the probability of wellbore collapse where formations are susceptible to such. Further, implementations of a downhole liner delivery tool can create an effective pressure barrier or seal with minimal drilled wellbore diameter reduction. (for example, with a relatively thin liner). Further, implementations of a downhole liner delivery tool can be implemented as part of a BHA. In other examples, implementations of a downhole liner delivery tool can be run as the lowest tool on a dedicated intervention run in a workstring. Further, implementations of a downhole liner delivery tool can be mechanical and actuated on demand from a terranean surface (for example, using a dropped member, such as a ball) or can be electromechanical with downlink commands used instead of a dropped member to actuate a liner deployment assembly of the tool. As another example, implementations of a downhole liner delivery tool can deploy a flexible liner, which is impregnated and then filled with, for example, a resin and inflated to the wellbore diameter to seal the formation. As another example, implementations of a downhole liner delivery tool can include a liner that cures in place to form a hard "pipe in pipe" barrier with a resin plug on the inner diameter. As a further example, implementations of a downhole liner delivery tool can include "leave in place" components that can be drilled through in a subsequent drilling operation. As another example, implementations of a downhole liner delivery tool can be used to stop fluid losses to the formation as quickly as possible and also avoid high loss rates of any remedial fluid or solids that are pumped into the well to cure the losses, which can be washed away into the formation before they have time to set and plug the holes. As a further example, implementations of a downhole liner delivery tool can provide a mechanical barrier, which holds a chemical (resin or cement) in place as it cures in the form of a combination of resin and liner material, which also has high pressure retaining ability when cured. Thus, savings of hundreds of thousands if not millions of dollars can be achieved with the example implementations of the a downhole delivery tool according to the present disclosure.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

FIGS. 1A-1D are schematic illustrations of an example implementation of a wellbore system 100 that includes a downhole liner delivery tool 200 during an operation to deploy a wellbore liner. Generally, the downhole liner delivery tool 200 can be operated to place a non-permeable or semi-permeable membrane across a formation section of a wellbore in a subterranean geologic formation. The membrane, in some aspects, may be capable of reducing drilling fluid losses during a drilling operation to form the wellbore. For example, drilling fluid loss mitigation through use of the membrane system of the downhole liner delivery tool 200 may help speed up drilling operations or continue interrupted drilling operations, or both.

Figure 1A:
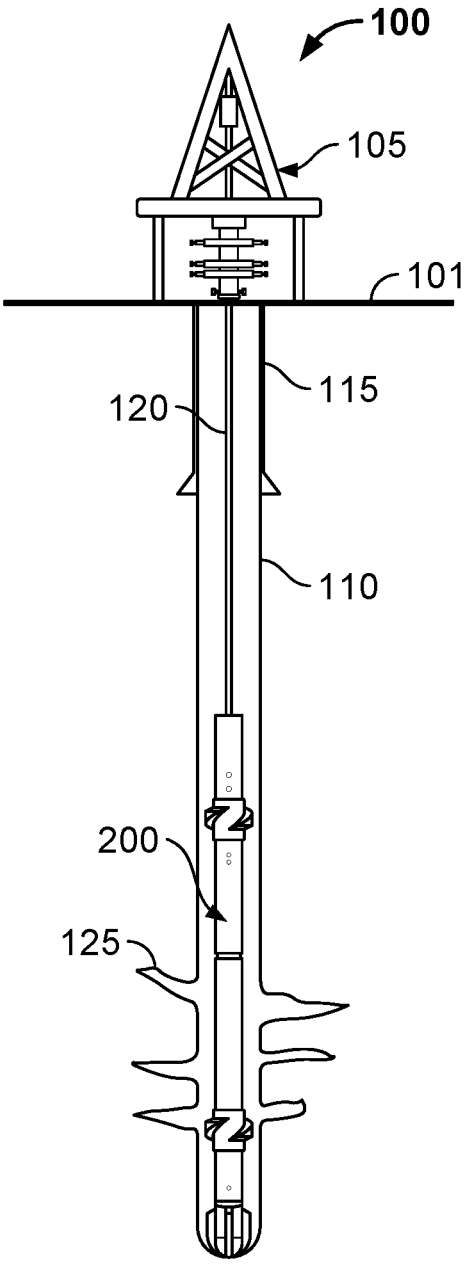
FIGS. 1A-1D are schematic illustrations of an example implementation of a wellbore system that includes a downhole liner delivery tool during an operation to deploy a wellbore liner according to the present disclosure.

As shown in FIG. 1A, the wellbore system 100 includes a rig 105 (for example, a workover rig) that is positioned on a terranean surface 101 and over a wellbore 110 that is formed from the terranean surface 101 into one or more subterranean formations that include, for example, cracks 125 (also called voids or widths) that emanate from the wellbore 110 and cause lost circulation of a wellbore fluid. In this example, one or more casings 115 can be installed in the wellbore 110 uphole of the cracks 125.

As shown in this example, the downhole liner delivery tool 200 can be run into a wellbore 110 on a work string 120 (for example, a tubular work string that is threadingly coupled to the downhole liner delivery tool 200) as part of a BHA. The work string 120 that is coupled to the downhole liner delivery tool 200 may be moved through the wellbore 110 to one or more particular depths of the wellbore 110, such as, for example, to a location (or vertically adjacent a location) in which drilling fluid was lost or would be lost into a subterranean (for example, rock formation, geologic formation) from the wellbore 110 through cracks 125. Such losses may occur, for example, due to inconsistent wellbore dimensions (for example, varying diameter of the wellbore 110 over a vertical section of the wellbore 110 between the terranean surface 101 and a bottom of the wellbore), low-pressure formations, fissures and fractures, sand, or the geologic properties of the formation.

Figure 2A:
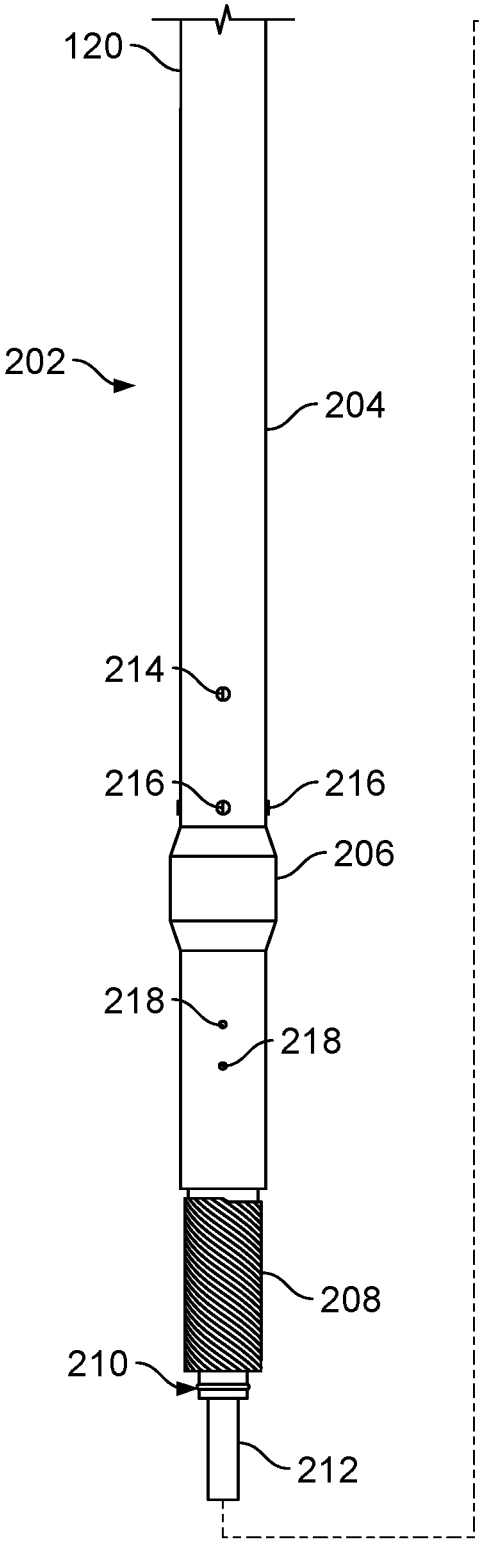
FIGS. 2A-2B are schematic illustrations of an example implementation of a downhole liner delivery tool according to the present disclosure.
Figure 2B:
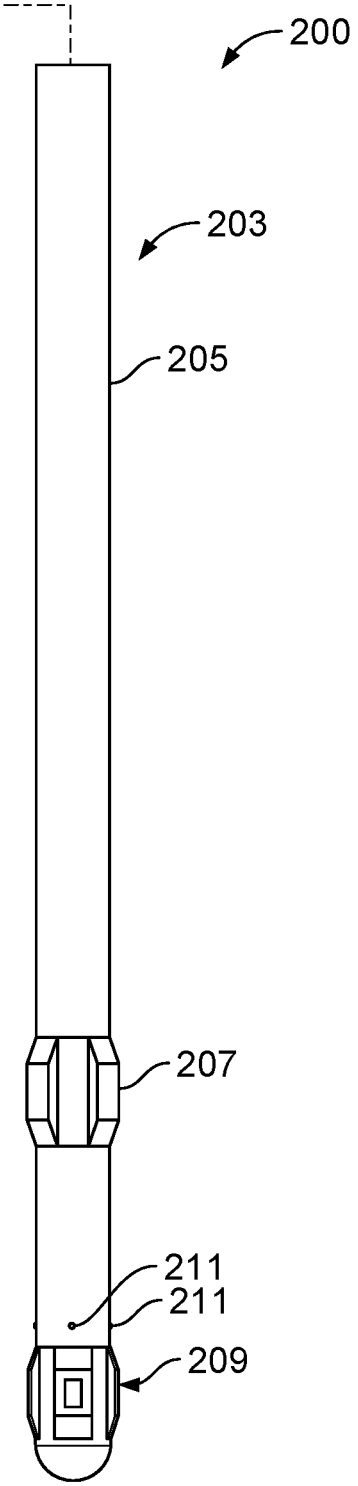

As shown in FIG. 1A, the downhole liner delivery tool 200 is run into the wellbore 110 until a downhole end of the tool 200 is positioned downhole of the cracks 125 (or, for example, downhole from where a liner is to be deployed in the wellbore 110. Turning briefly to FIGS. 2A-2B, these figures show schematic illustrations of an example implementation of the downhole liner delivery tool 200. As shown in FIGS. 2A-2B, the downhole liner delivery tool 200 includes an upper sub-assembly (or "upper sub") 202 and a lower sub-assembly (or "lower sub") 203 that can be coupled together when running in the wellbore 110, such as through a threaded connection 208. For instance, the threaded connection 208 can be threaded into the lower sub-assembly 203 (as shown by the dashed line).

In this example, the upper sub 202 includes a housing 204 (that can be threaded onto the conveyance 120 or attached to a BHA) and an upper sub stabilizer 206 that can act as a centralizer (for instance, to help maintain the downhole liner delivery tool 200 at or near a central radial axis of the wellbore 110 during operation). An index pin 214 is positioned in the housing 204, as are circulation ports 216. In this example, the circulation ports 216 (which can number 1, 2, or more) allow fluid communication between an inner volume of the housing 204 and the wellbore 110. Shear pins 218 are positioned in the housing 204. As describes, the threaded connection 208 is formed at a downhole end of the upper sub 202. As shown in FIG. 2A, the top liner anchor 210 extends from the housing 204, as does a portion of a wellbore liner (or "liner") 212. In some aspects, the liner 212 can be made of woven fabric such as glass fiber, Aramid, or carbon fiber.

Turning to FIG. 2B, the lower sub 203 includes a housing 205 that can be coupled (for example, threadingly) to the threaded connection 208. A lower sub stabilizer 207 is positioned on the housing 205 and can act as a centralizer (for instance, to help maintain the downhole liner delivery tool 200 at or near a central radial axis of the wellbore 110 during operation). Lower sub shear pins 211 are positioned on the housing 205, as is a nose assembly 209 that defines a downhole end of the downhole liner delivery tool 200.

Figure 2C:
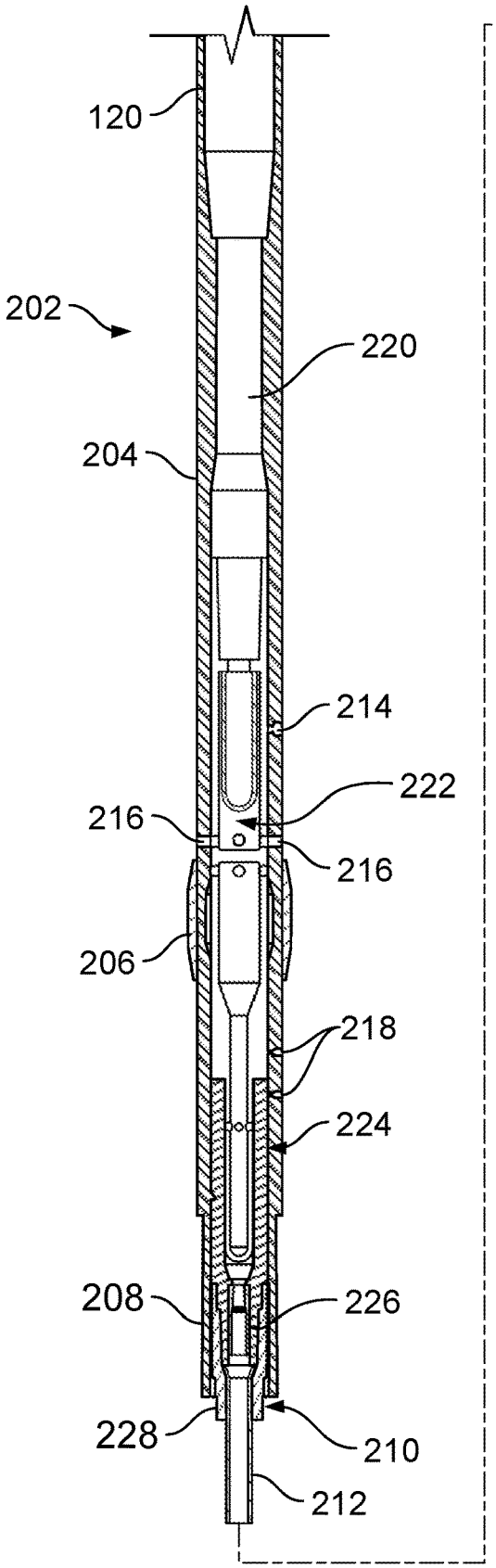
FIGS. 2C-2D are schematic cross-sectional illustrations of the example implementation of the downhole liner delivery tool of FIGS. 2A-2B.
Figure 2D:
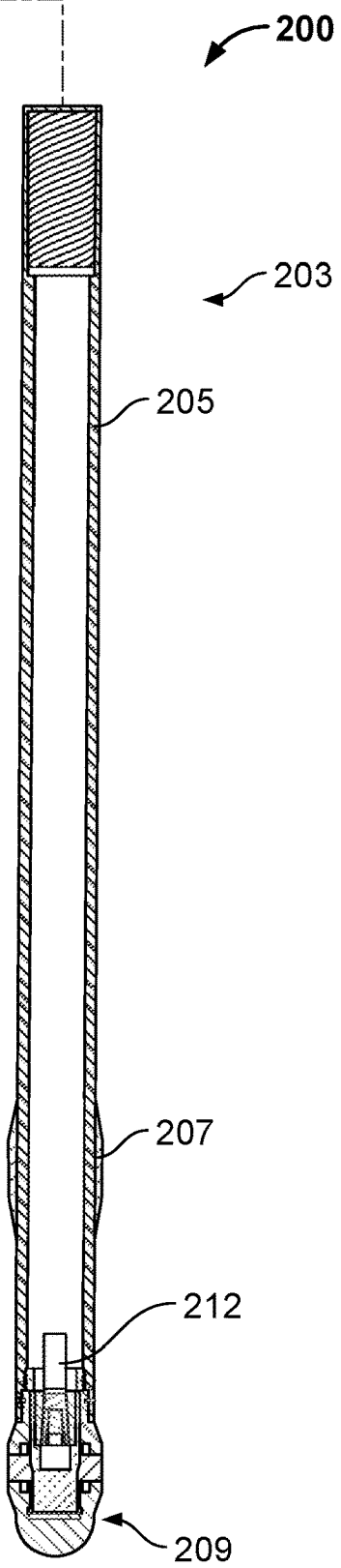

Turning now to FIGS. 2C-2D, these figures show schematic cross-sectional illustrations of the example implementation of the downhole liner delivery tool 200 of FIGS. 2A-2B. For example, FIG. 2C shows a schematic cross-sectional illustration of the upper sub 202 of the downhole liner delivery tool 200 in a running in position (for example, as shown in FIG. 1A). The upper sub 202 includes, positioned within the housing 204, a downhole conveyance connection 220 (that connects the tool 200 to the conveyance 120), a flow crossover sub-assembly 222 that includes the ports 216, a float housing 224, a float 226, and the top liner anchor 210 (which includes a seal 228). In this example, the liner 212 is connected to the top liner anchor 210 (during the deployment process, prior to disconnect). As shown in FIG. 2C, during the run in process, the float housing 224 is secured to the housing 204 with shear pins 218, and the index pin 214 couples the flow crossover sub-assembly 222 to the housing 204 (which can move relative to each other as described later).

FIG. 2D shows a schematic cross-sectional illustration of the lower sub 203 of the downhole liner delivery tool 200 in the running in position (for example, as shown in FIG. 1A).

Figure 1B:
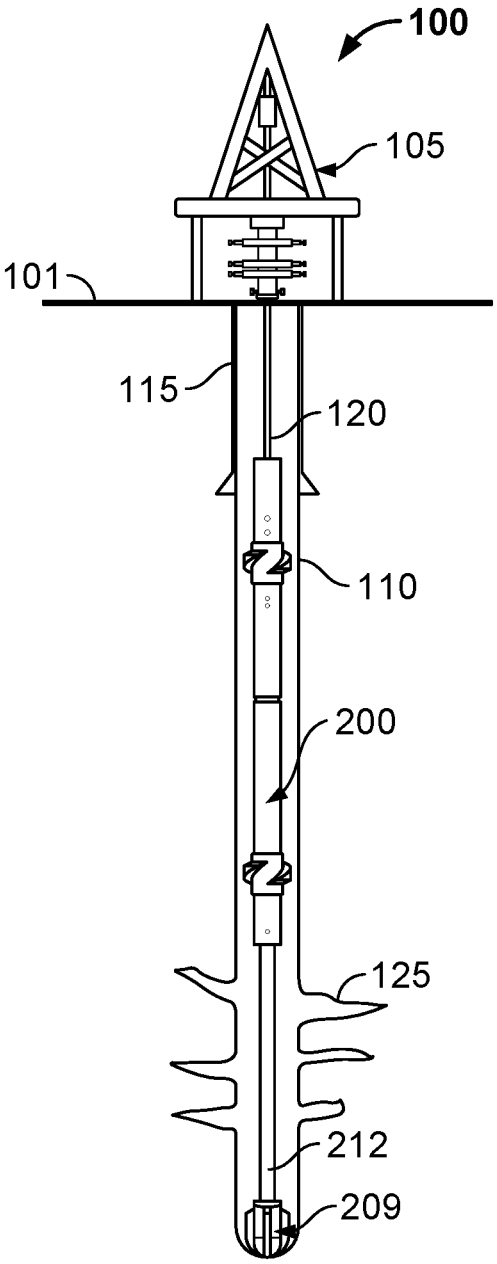
Figure 1C:
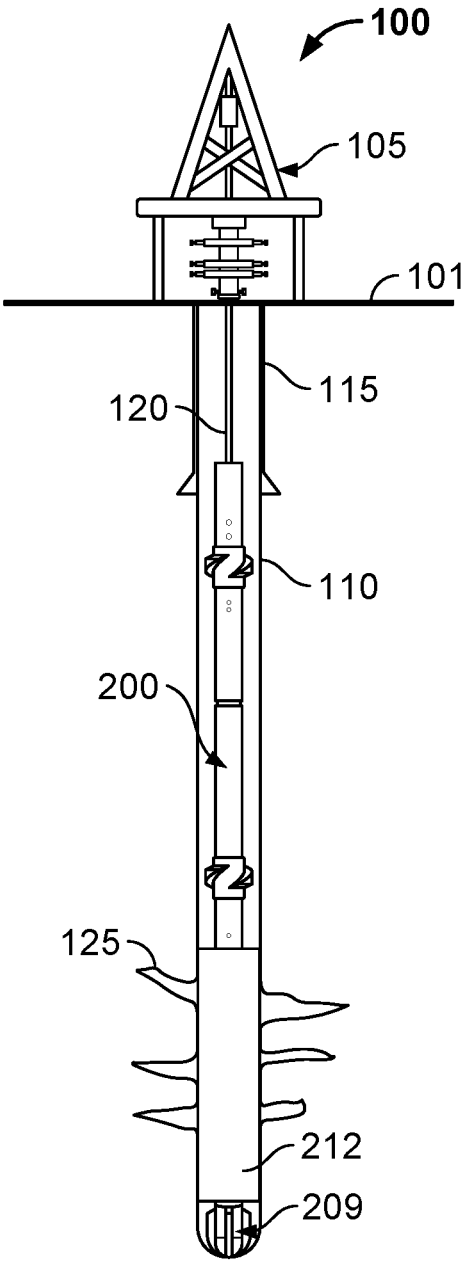
Figure 1D:
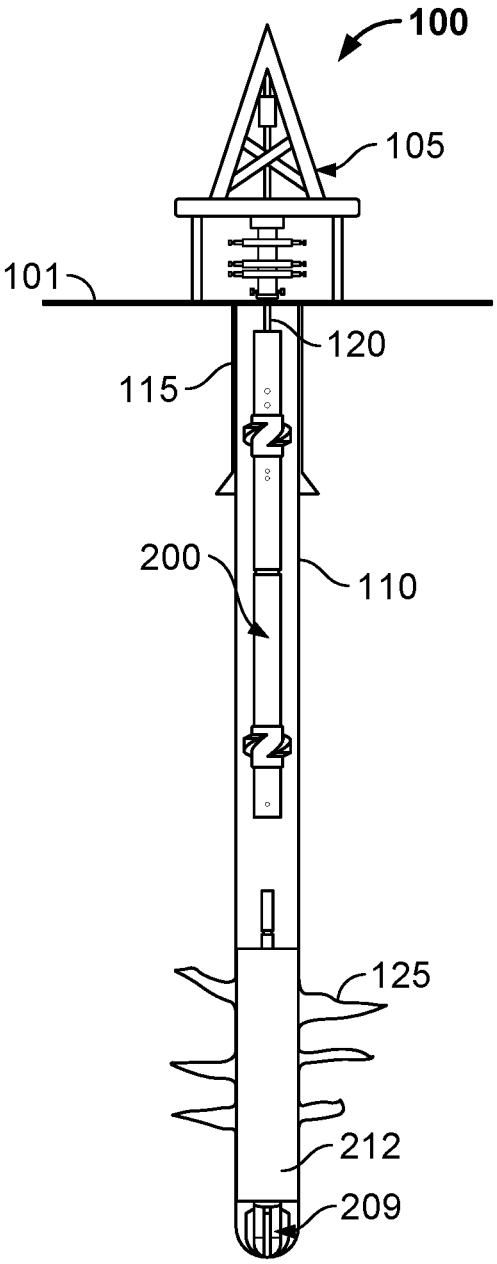

Turning now to FIG. 2D, a schematic cross-sectional illustration of the lower sub 203 of the downhole liner delivery tool 200 is shown. The lower sub 203 includes the nose assembly 209 into which the liner 212 is anchored opposite its anchoring location in the top liner anchor 210. Thus, during the run-in process, the liner 212 is connected at the top liner anchor 210 and the nose assembly 209. Although FIGS. 1C-1D show only the anchored portions of the liner 212, the liner 212 is stored and extends within the housing 205 from the top liner anchor 210 to the nose assembly 209 in the initial run-in position as shown.

Figure 8A:
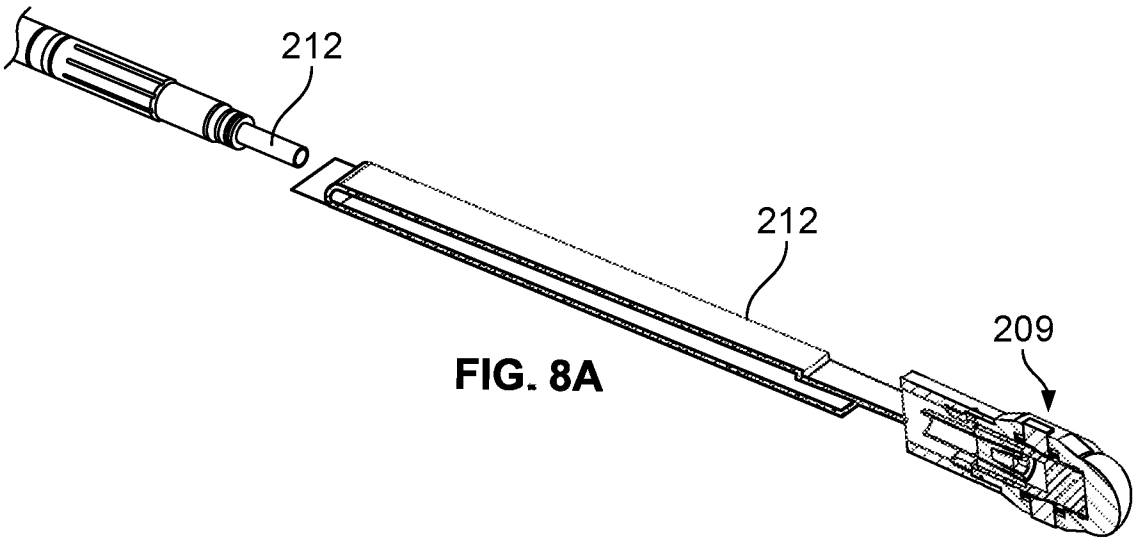
FIGS. 8A-8C are schematic illustrations of a liner of a downhole liner delivery tool according to the present disclosure.
Figure 8C:
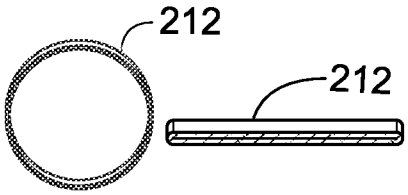
Figure 8B:
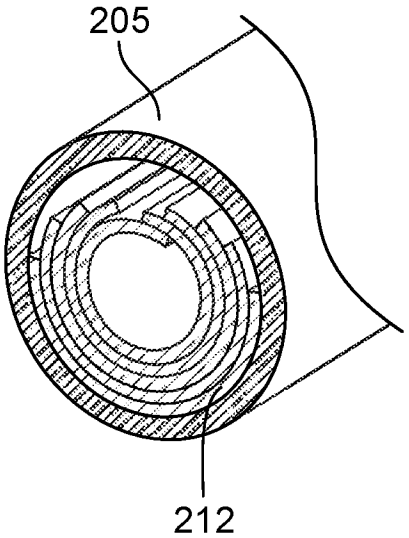

Turning briefly to FIGS. 8A-8C, these figures show schematic illustrations of the liner 212 of the downhole liner delivery tool 200 as stored within the tool 200 prior to deployment in the wellbore 110. For example, in some aspects, the liner 212 can be, when deployed from the tool 200, much longer than the housing 205. Thus, when stored, the liner 212 can be folded or rolled within the housing 205. As shown in FIG. 8A, for instance, in an example aspect of the downhole liner delivery tool 200, the liner 212 can be flattened and folded in a lengthwise direction to be stored within the housing 205 (not shown here) while connected between the top liner anchor 210 and the nose assembly 209. As shown in FIG. 8C, a liner 212 of a circular cross-section (when expanded), can be compressed into a relatively flat position to be stored prior to deployment. For a liner 212 that is, for instance, about 6 inches in outer diameter when radially expanded, the flattened liner 212 can be about 9 inches in width to be stored in the housing 205. As another example, FIG. 8B shows the liner 212 stored in the housing 205 in a rolled position.

Figure 3A:
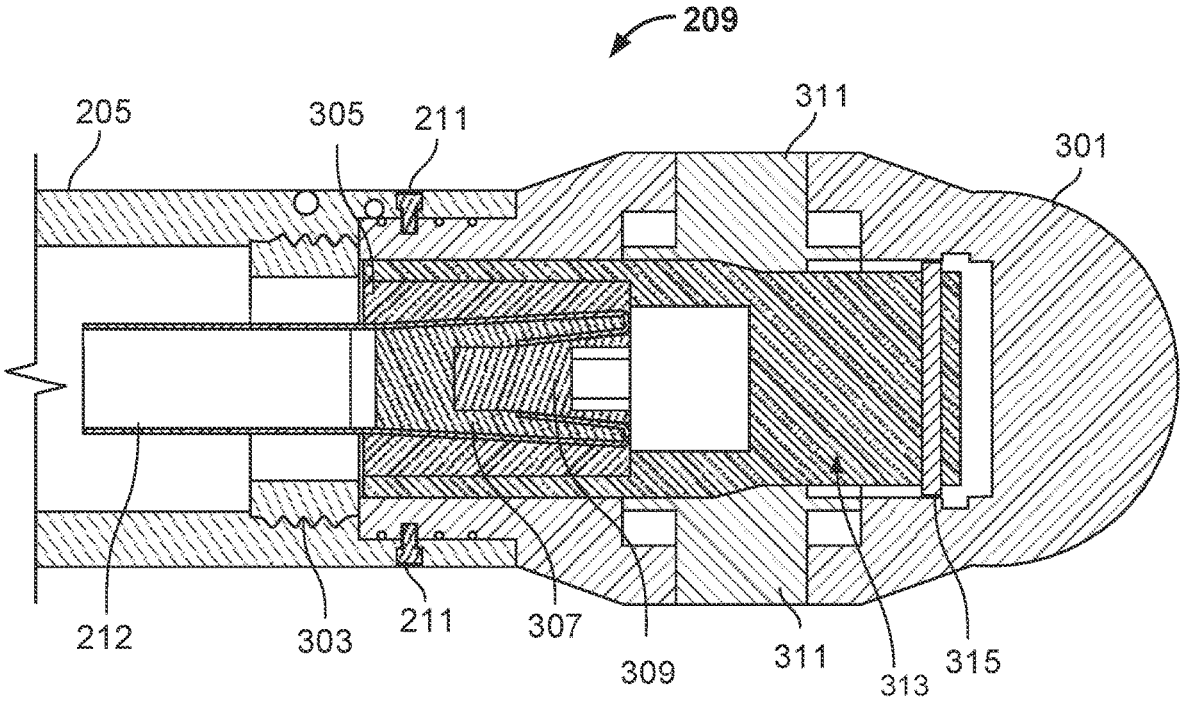
FIGS. 3A-3B are schematic cross-sectional illustrations of a nose assembly of a downhole liner delivery tool according to the present disclosure.
Figure 3B:
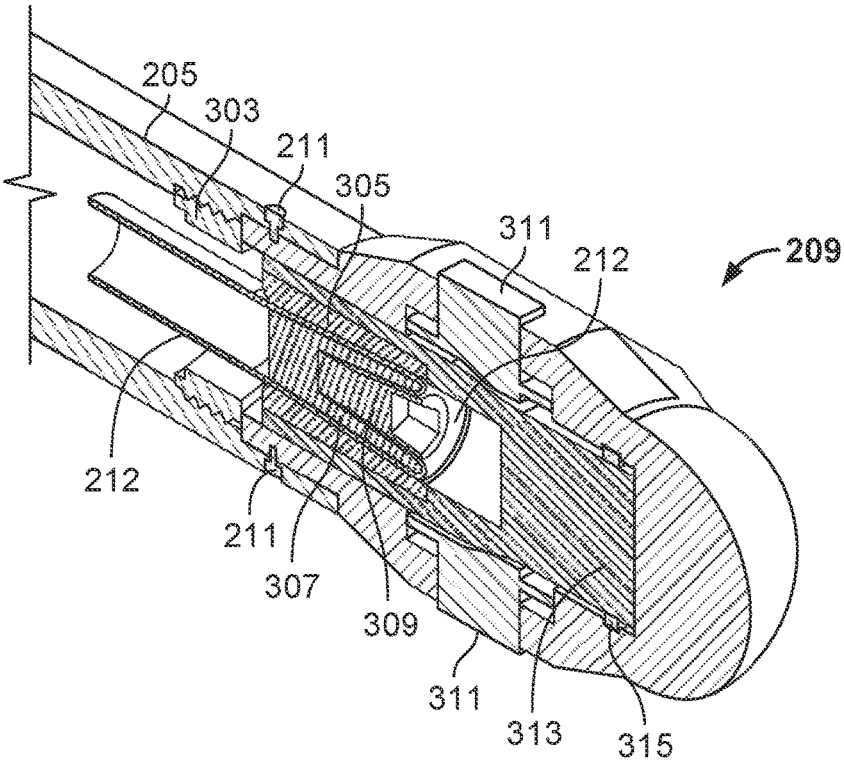

Turning now to FIGS. 3A-3B, these figures show schematic cross-sectional illustrations of the nose assembly 209 of the downhole liner delivery tool 200. As shown in this example implementation, the nose assembly 209 includes a nose body 301 that is coupled to the housing 205 with shear pins 211. A disengagement ring 303 is also detachably coupled to the housing 205 and abuts the nose body 301. The liner 212 is coupled to a main nose anchor 305, which is threaded within a shuttle 313. Further connecting the liner 212 to the nose assembly 209 is a male nose anchor 309 which is threaded within a female nose anchor 307. The shuttle 313 extends into the nose body 301 and radially abuts expanding pads 311. As explained in more detail later, the expanding pads 311 include grips or teeth that can attach to the wellbore 110 (or a casing within the wellbore 110, or both) to secure the nose assembly 209 at a particular location in the wellbore 110).

Turning back to FIG. 1B, this figure shows the downhole liner delivery tool 200 during a deployment operation to deploy the liner 212 out of the housing 205 and into the wellbore 110 while still connected to the main nose anchor 305 and the top liner anchor 210. A more detailed description of this process is described with reference to FIGS. 4A-4D, which are schematic illustrations of an example implementation of the downhole liner delivery tool 200 during the deployment operation.

Figure 4A:
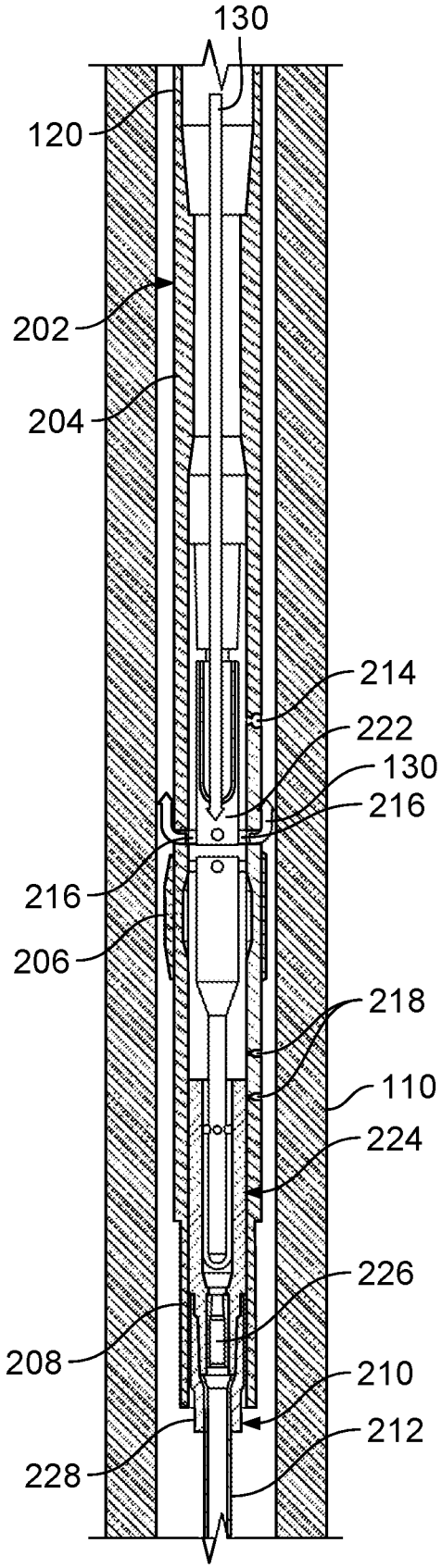
FIGS. 4A-4D are schematic illustrations of an example implementation of a downhole liner delivery tool during operation according to the present disclosure.

Turning to FIG. 4A, as shown, to being the deployment operation, a wellbore fluid 130 is circulated from the terranean surface 101, through the downhole conveyance 120, and into the upper sub 202. In some aspects, the wellbore fluid 130 can be a resin 130 (or epoxy or other hardeneable or semi-hardenable liquid) that can cure and attach the liner 212 to the wellbore 110. FIG. 4A shows the resin 130 pumped through the downhole conveyance connection 220, into the flow crossover sub-assembly 222, and out of the ports 216 into an annulus between the tool 200 and the wellbore 110. The resin 130 can then flow back to the terranean surface 101, as FIG. 4A can represent a flushing out process of the tool 200 by circulating the resin 130 there through.

Figure 4B:
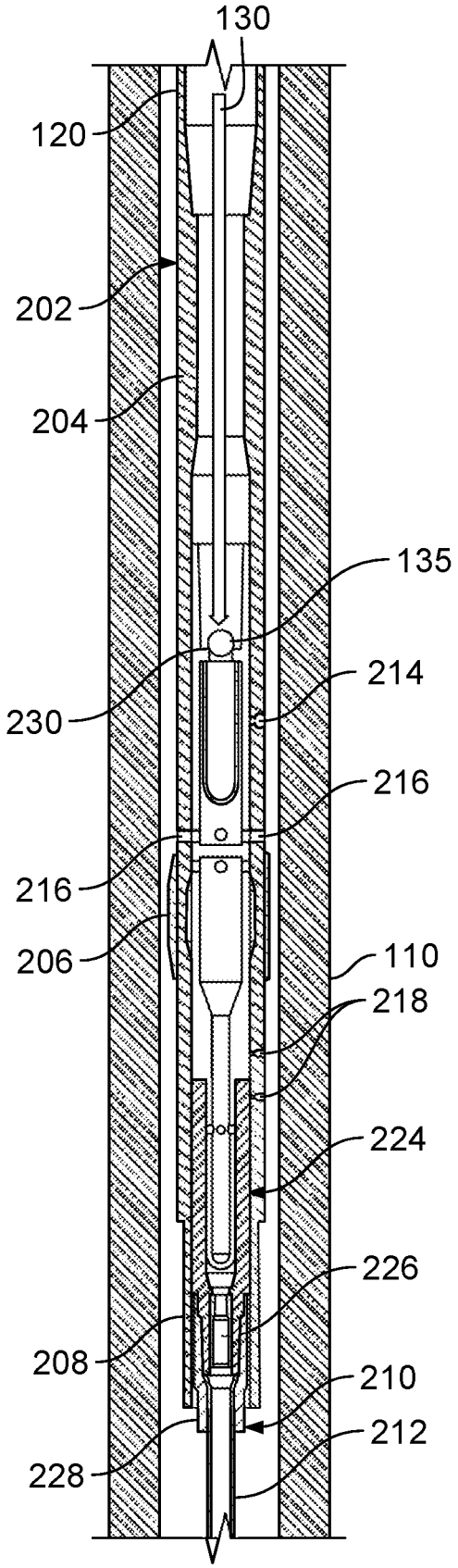

As shown in FIG. 4B, to activate the downhole liner delivery tool 200 to start the deployment operation, a member 135 (such as a ball 135) is circulated with the resin 130 from the terranean surface 101 and lands on a seat 230 formed in the flow crossover sub-assembly 222. In some aspects, the ball 135 can be made of an extrudable material and have a density similar to the resin 130 being pumped. The ball 135 can be pumped down with some resin 130 ahead of it to flush out any mud in the conveyance 120 and avoid contamination of the liner 212 (as described in FIG. 4A).

Figure 4C:
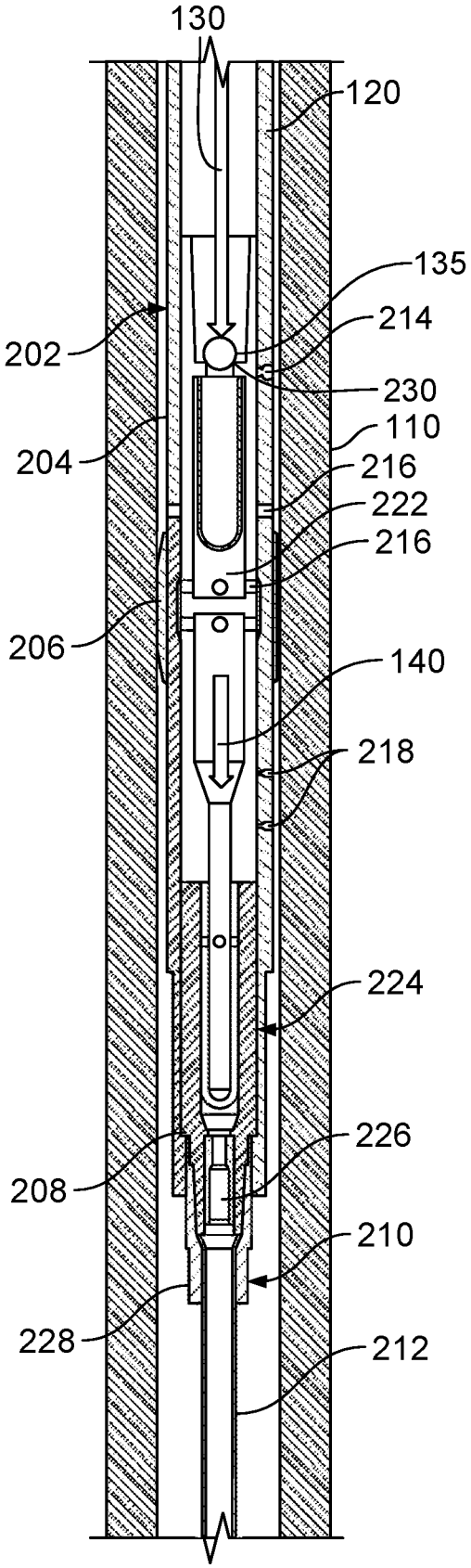

As pressure increases uphole of the ball 135 by the circulated resin 130, the flow crossover sub-assembly 222 is urged downward and as the pressure force increases, shear pins 218, which hold the flow crossover sub-assembly 222 and the float housing 224 in position, are broken. As shown in FIG. 4C, once the shear pins 218 are broken, movement 140 occurs and the flow crossover sub-assembly 222 moves down and opens a flow path to an inner bore of the upper sub 202.

Movement of the flow crossover sub-assembly 222 is stopped by the index pin 214, which, in this example, rides in a groove formed on the flow crossover sub-assembly 222 until it stops in the correct position and also prevents reverse motion, which would open the circulation ports 216 to the annulus. Thus, in the configuration of the downhole liner delivery tool 200 shown in FIG. 4C, the circulation ports 216 are now fluidly decoupled from the annulus.

Figure 9:
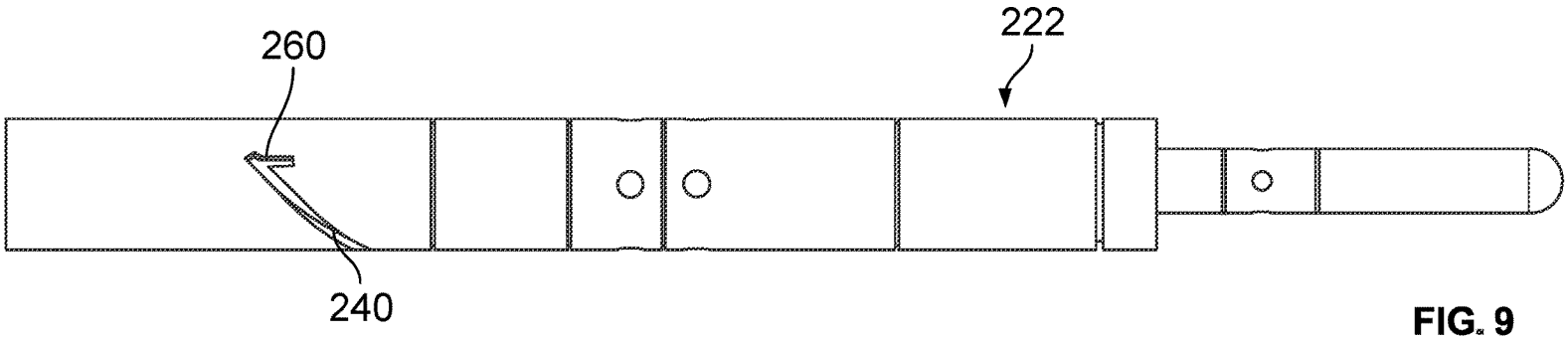
FIG. 9 is a schematic illustration of a flow crossover sub-assembly of a downhole liner delivery tool according to the present disclosure.

Turning briefly to FIG. 9, this figure shows the flow crossover sub-assembly 222 of the downhole liner delivery tool 200 and the groove 240 in which the index pin 214 can ride. As shown, the groove 240 wraps radially around an outer diameter of the flow crossover sub-assembly 222 and includes, at an uphole end, a slot 260. When the flow crossover sub-assembly 222 is moved downward in movement 140, the travel path of the index pin 214 within the groove 240 (which begins at a downhole end of the groove 240) causes the flow crossover sub-assembly 222 to rotate. The length and angle of the groove 240 can control the amount of rotation and the allowable downhole movement distance during movement 140. When the index pin 214 hits the uphole end of the groove 240 at which the slot 260 is formed, movement stops. And, if later, a pressure directed in an uphole direction tries to move the flow crossover sub-assembly 222 back uphole, then the index pin 214 drops into the slot 260 and prevents such uphole movement.

Figure 4D:
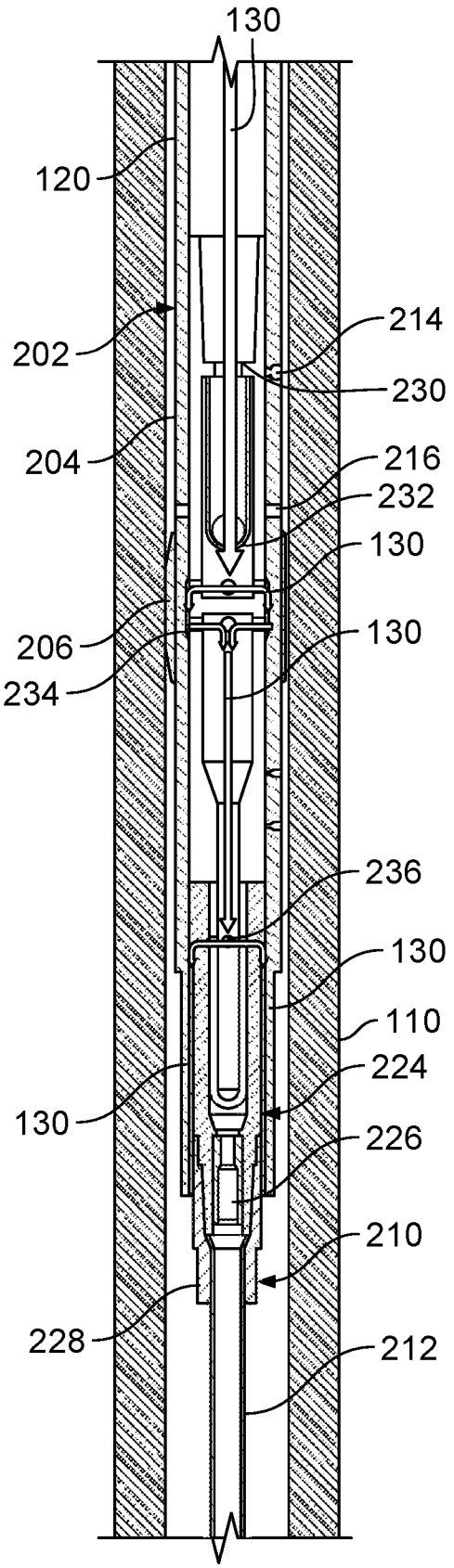
Figure 5:
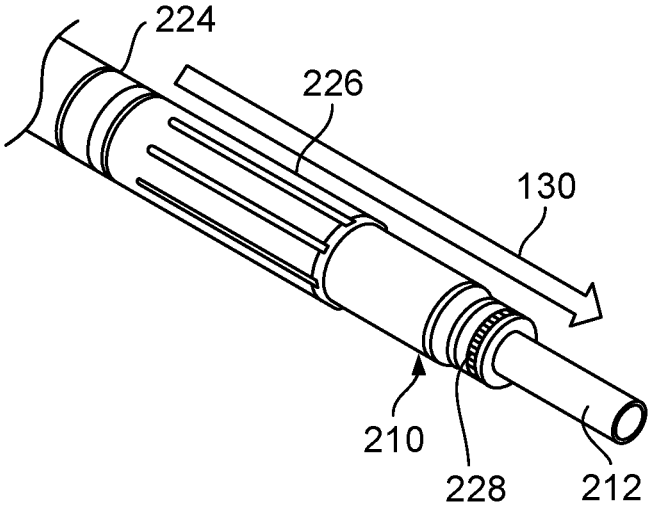
FIG. 5 is a schematic illustration of a portion of a downhole liner delivery tool during operation according to the present disclosure.

Turning now to FIG. 4D, as pressure from the resin 130 is increased further, the ball 135 can be extruded through the seat 230 and lands in the catch 232. The resin 130, with the ports 216 now closed to the annulus, circulates from the ports 216 into a bypass 234 (between the upper sub stabilizer 206 and the flow crossover sub-assembly 222) and then into an inner diameter of the float housing 224. When the flow of the resin 130 reaches ports 236, the resin 130 exits the inner diameter of the float housing 224 and flows out over the outer diameter of the float housing 224 to the housing 205 that encloses the liner 212. Turning briefly to FIG. 5, this figure illustrates the flow of the resin 130 out over the float housing 224 and the top anchor lock 210 (a portion of which are enclosed in the housing 204 and the housing 205) and to the liner 212 (which is enclosed in the housing 205). During this step of the operation, the resin 130 begins to soak into the liner 212 inside the housing 205.

Figure 6A:
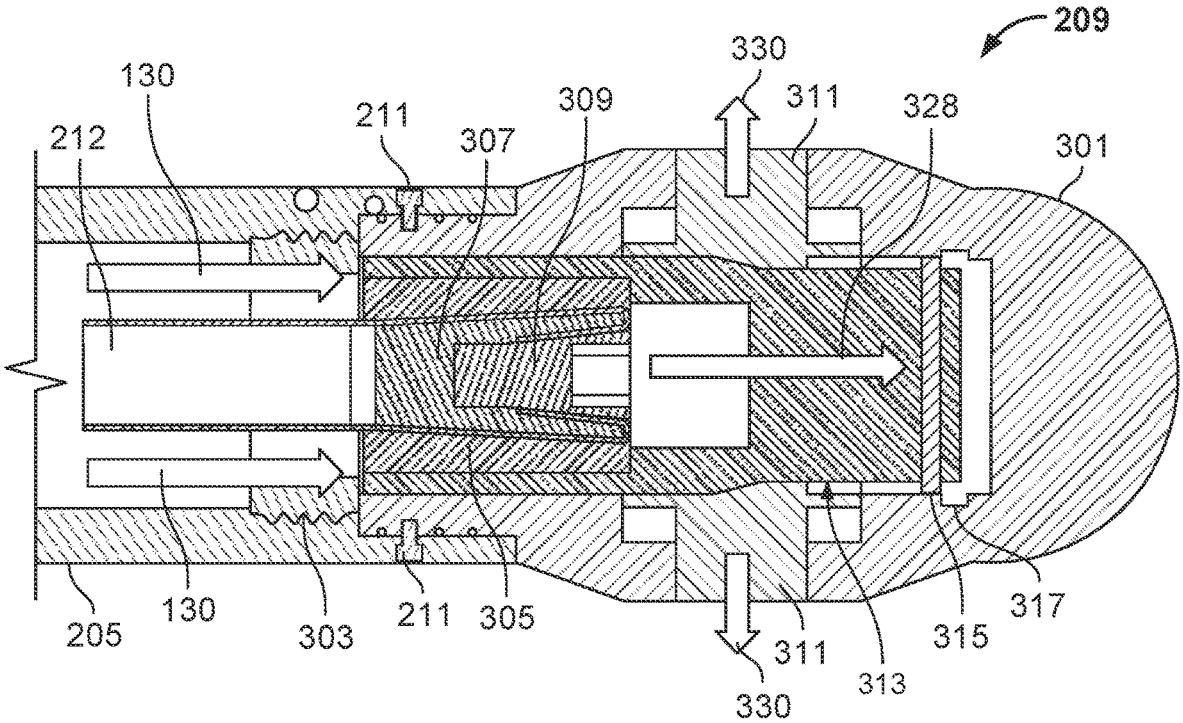
FIGS. 6A-6C are schematic illustrations of a nose assembly of a downhole liner delivery tool during operation according to the present disclosure.
Figure 6B:
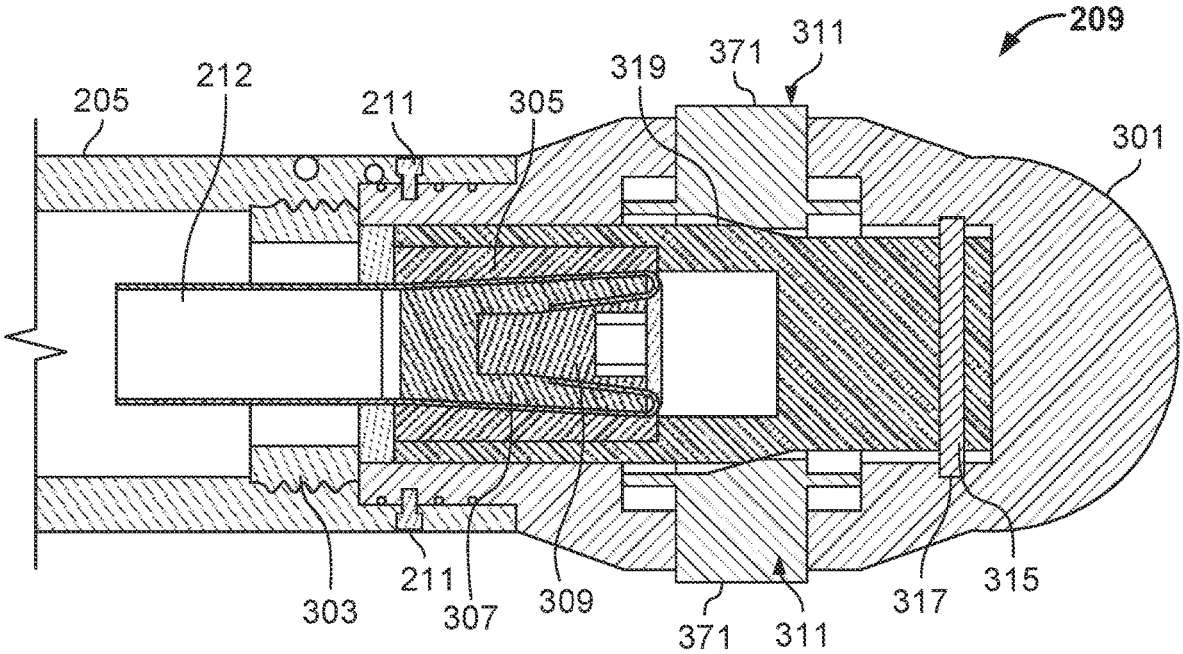
Figure 6C:
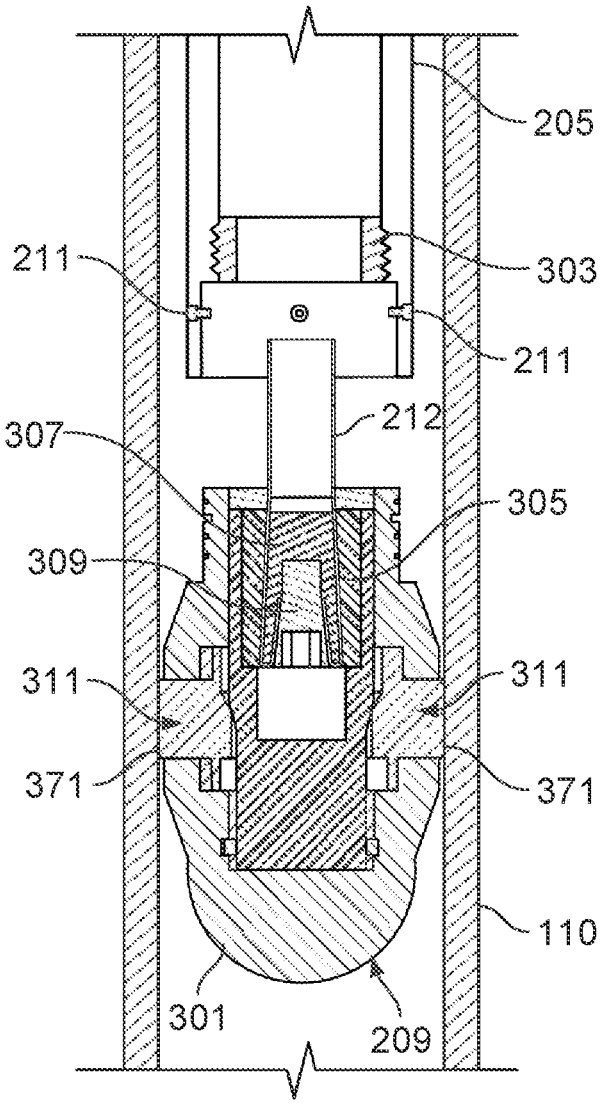

Turning now to FIGS. 6A-6C, these figures are schematic illustrations of the nose assembly 209 of the downhole liner delivery tool 200 once the resin 130 is pumped over the liner 212 and to the nose assembly 209 in order to anchor the nose assembly 209 to the wellbore 110. Turning to FIGS. 6A-6B, this figures shows the resin 130 flowing to, and then filling, the nose body 301. As the resin 130 fills the nose body 301, pressure is applied to create movement 328 of the shuttle 313. As the shuttle 313 moves with movement 328, a shoulder 319 of the shuttle 313 pushes the expanding pads 311 outward with movement 330 (shown in FIG. 6B). As the expanding pads 311 are urged outward, the pads 311 engage the wellbore 110 with grips 371 to prevent uphole movement and anchor the nose assembly 209 to the wellbore 110 (or casing in the wellbore 110). FIG. 6C shows the nose assembly 209 anchored to the wellbore 110.

Once the shuttle 313 is urged with movement 328 toward a downhole end of the nose assembly 209, a lock ring 315 that is positioned radially around the shuttle 313 snaps into a groove 317 formed on an interior surface of the nose body 301. Once snapped into the groove 317, the lock ring 315 holds the shuttle 313 in place, which also holds the expanding pads 311 in a radially expanded position against the wellbore 110.

Figure 10B:
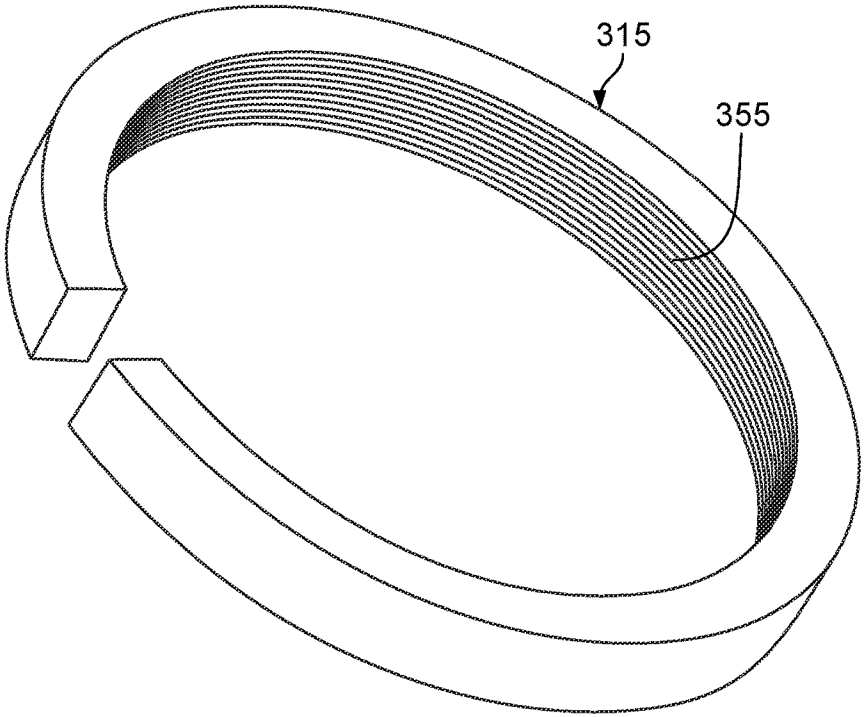
FIGS. 10A-10B are schematic illustrations of a shuttle and shuttle lock ring, respectively, of a downhole liner delivery tool according to the present disclosure.
Figure 10A:
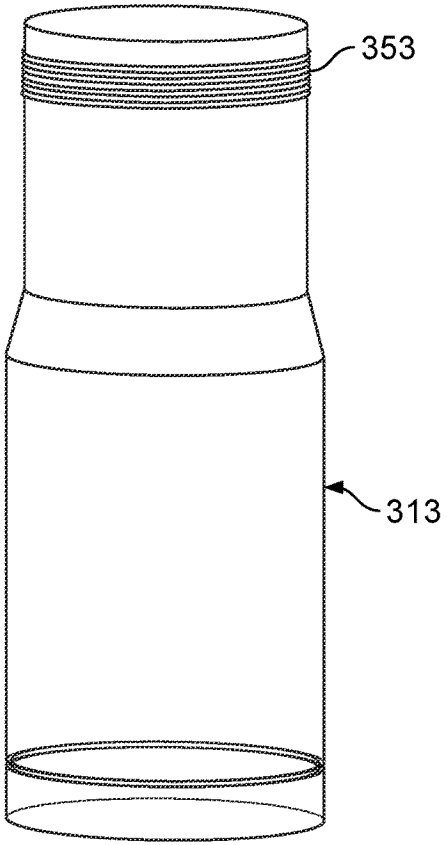

Turning briefly to FIGS. 10A-10B, these figures show schematic illustrations of the shuttle 313 and shuttle lock ring 315, respectively, of the downhole liner delivery tool 200. As shown, in this example implementation, the lock ring 315 is comprises of a split ring that includes threads 355 formed on an inner radial surface. The shuttle 313 also includes corresponding threads 353 that can engage the threads 355 (and disengage, as described later).

Turning now to FIG. 6C, this figure shows a step of the deployment operation in which the nose assembly 209 is released from the housing 205, while being anchored to the wellbore 110. As the pressure of the resin 130 is increased, shear pins 211 are broken, which releases the nose body 301 from the housing 205. Once released, the housing 205 (and disengagement ring 303) can be moved uphole by uphole movement of the conveyance 120. While the housing 205 is moved uphole, the liner 212 remains connected to the nose body 301 but plays out from the housing 205 during such movement. At this point, the liner 212 can be exposed to the fluids in the wellbore annulus (resin again) for the first time. With the nose assembly 209 anchored in place, the tool 200 is pulled back up the wellbore 110 and this pulls the liner 212 from the housing 205. In some aspects, the pull-back distance can be measured so that the liner 212 is not over or under deployed.

Figure 7A:
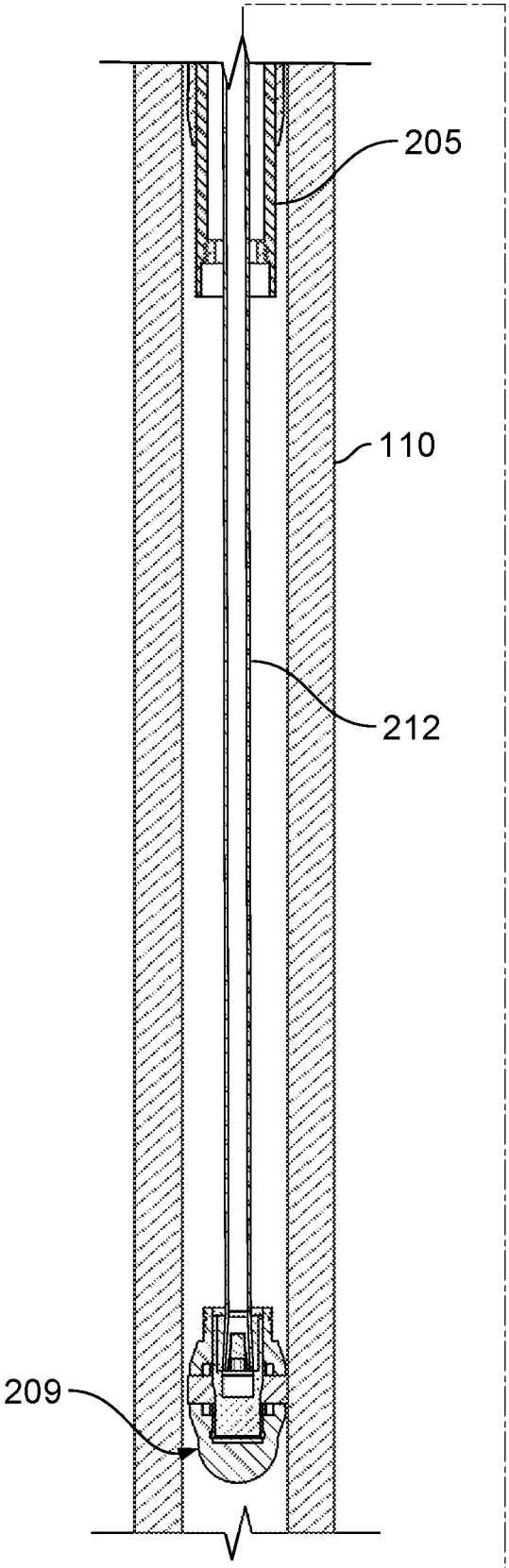
FIGS. 7A-7G are schematic illustrations of an example implementation of a downhole liner delivery tool during operation according to the present disclosure.
Figure 7B:
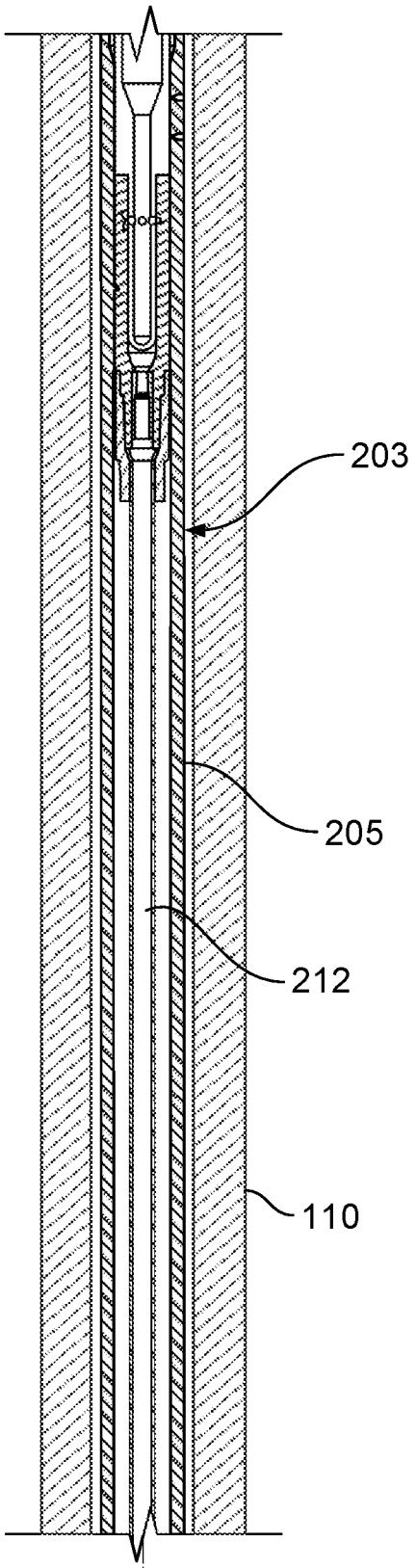

Turning to FIGS. 7A-7G, these figures show schematic illustrations the further steps of the deployment operation of the downhole liner delivery tool 200. Turning to FIGS. 7A-7B, these figures show the housing 205 pulled back (uphole) from the nose assembly 209 in order to deploy the liner 212 into the wellbore. This is also shown in FIG. 1B. At this part of the deployment operation, the liner 212 is still attached to the top liner anchor 210 as well as the nose assembly 209.

Figure 7C:
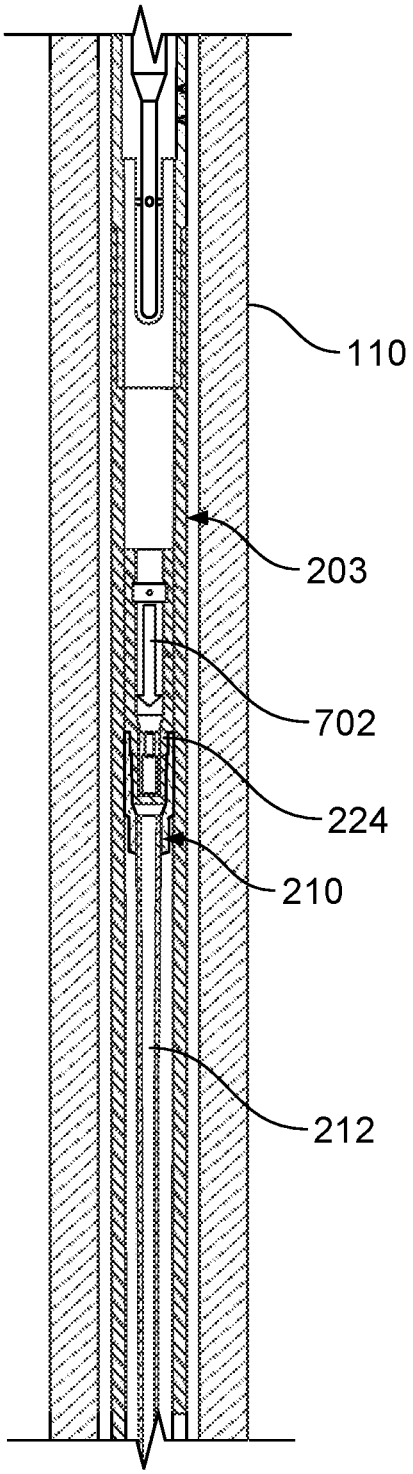

In order to further deploy the liner 212 in the wellbore 110, additional resin 130 can be circulated into the tool 200 to expand the liner 212. Turning to FIG. 7C, movement uphole of the conveyance 120 (and thus tool 200), operates to create movement 702 so that the float housing 224 detaches from the flow crossover sub-assembly 22 and slides downward.

Figure 7D:
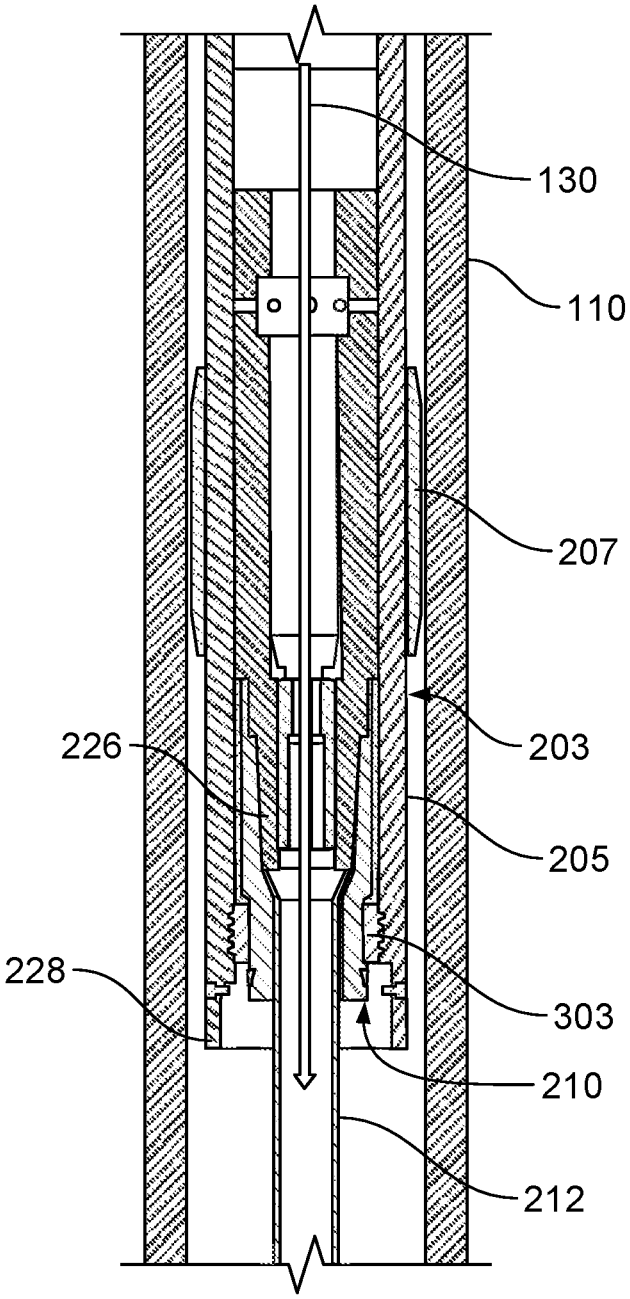
Figure 7E:
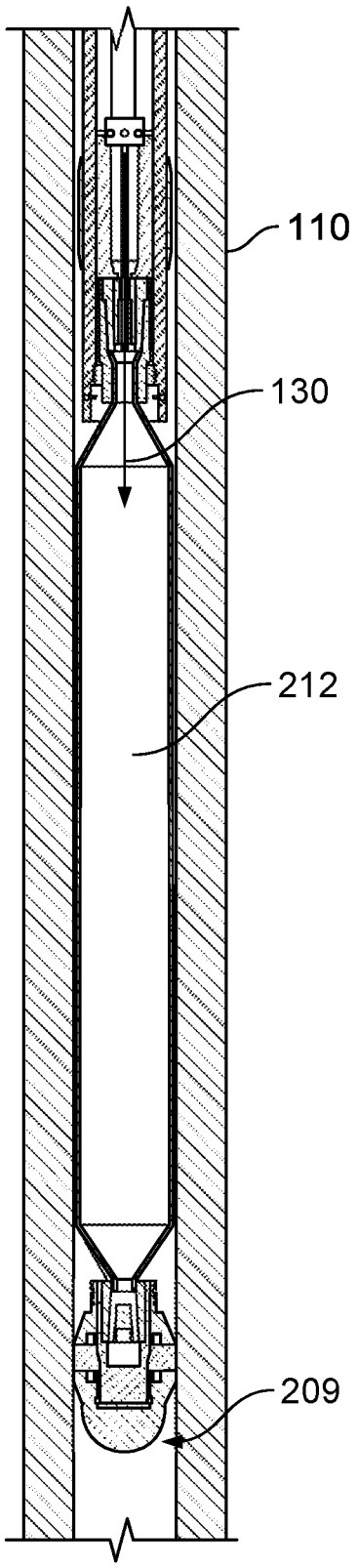

Turning to FIG. 7D, as shown, the resin 130 can be diverted into the inner diameter of the liner 212 in order to inflate it. As the liner 212 is deployed, the uphole movement of the tool 200 and the float housing 224 is detached from the flow crossover sub-assembly 222, the float housing 224 is pulled to the downhole end of the housing 204 as shown in FIG. 7D. When the float housing 224 detaches from the flow crossover sub-assembly 222, the flow of the resin 130 which was diverted from the inner diameter of the float housing 224 can now flow into the inner diameter of the float housing 224, through the float 226 and into the liner 212. In some aspects, a seal, such as an O-ring on the outer surface of the float housing 224 can prevent flow of the resin 130 from bypassing the interior of the liner 212.

Figure 11A:
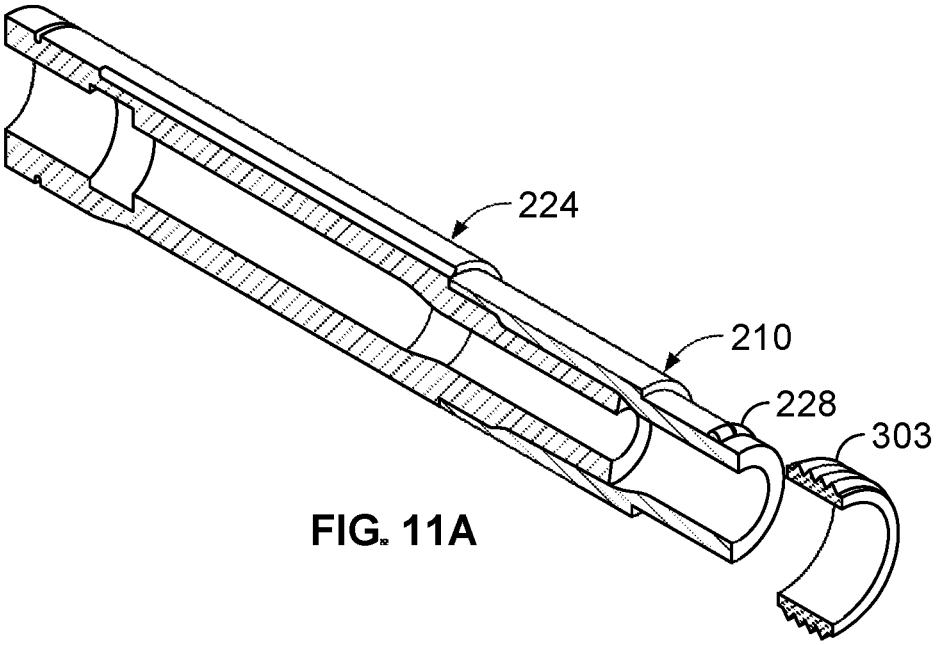
FIGS. 11A-11B are schematic illustrations of liner engagement assembly of a downhole liner delivery tool according to the present disclosure.
Figure 11B:
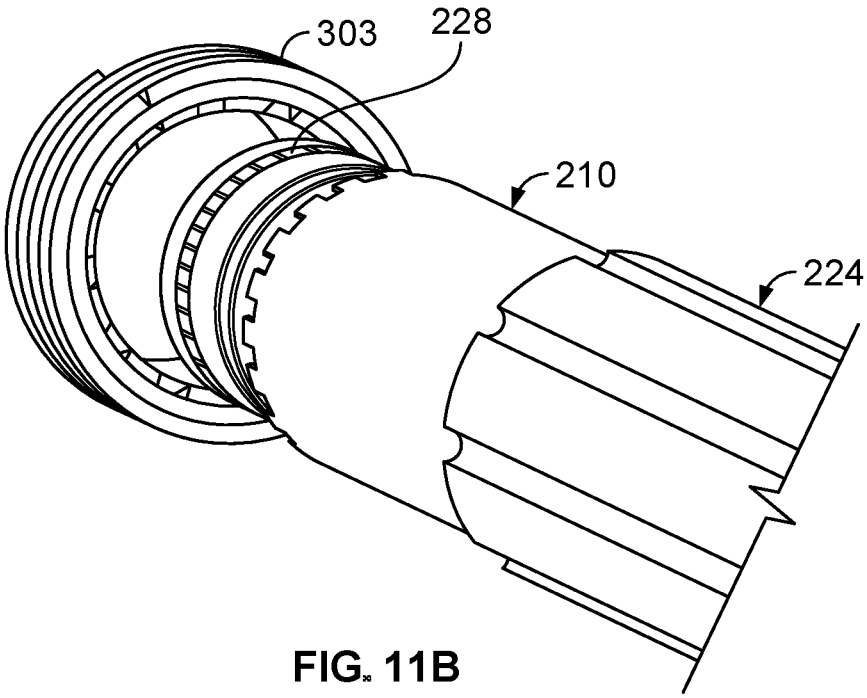

As further shown in FIG. 7D, uphole movement of the tool 200 can cause the top liner anchor 210 to socket into the disengagement ring 303 at a downhole end of the housing 205 of the lower sub 203. Turning briefly to FIGS. 11A-11B, these figures show schematic illustrations of the top liner anchor 210 and disengagement ring 303. The disengagement ring 303 sockets onto the top liner anchor 210 until it is past and uphole of the anchor seal 228. Flow of the resin 130 can now be through the inner diameter of the float housing 224 and float 226 and into the inner diameter of the liner 212. In this example, as shown, the seal 228 acts as an anchor lock to prevent the top liner anchor 210 from backing out of the disengagement ring 303 (in other words, disengaging while moving uphole) once socketed together.

Once the top liner anchor 210 sockets onto the disengagement ring 303, the liner 212 can be further expanded onto the wellbore 110 by further circulation of resin 130. For example, turning to FIG. 7E, the resin 130 is further circulated into the inner diameter of the liner 212, causing the liner 212 to expand against the wellbore 110 (or a casing installed in the wellbore 110). The liner 212, once expanded, can seal off any cracks 125 as shown in FIG. 1C.

Once the liner 212 seals off the cracks 125, the liner 212 can be released from at least a portion of the downhole liner delivery tool 200, so that the tool 200 can be run out of the wellbore 110 on the conveyance 120. For example, turning to FIG. 7F, as shown, the tool 200 can be manipulated so that the housing 205 releases to allow the liner 212 (attached to the top liner anchor 210 and float 226) within the wellbore 110.

Figure 7F:
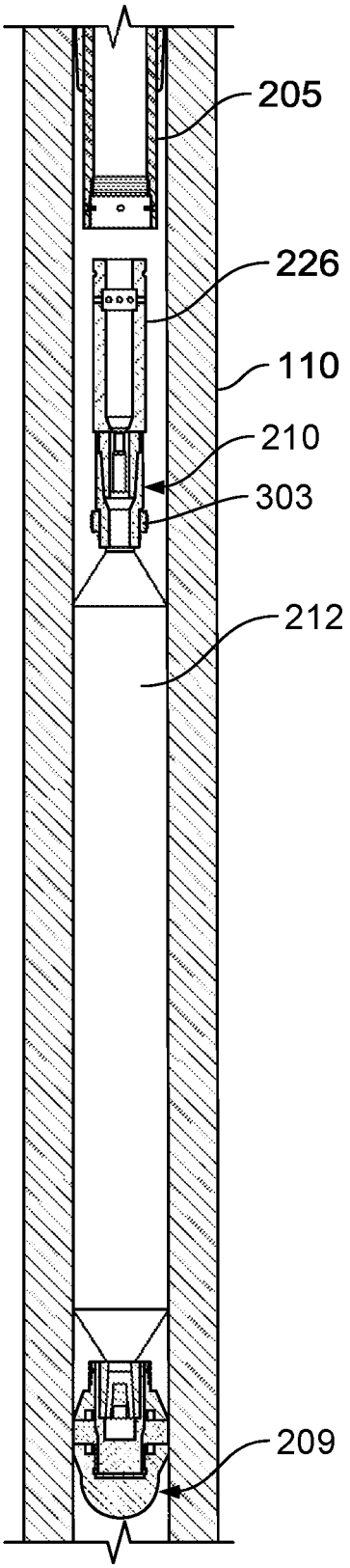
Figure 7G:
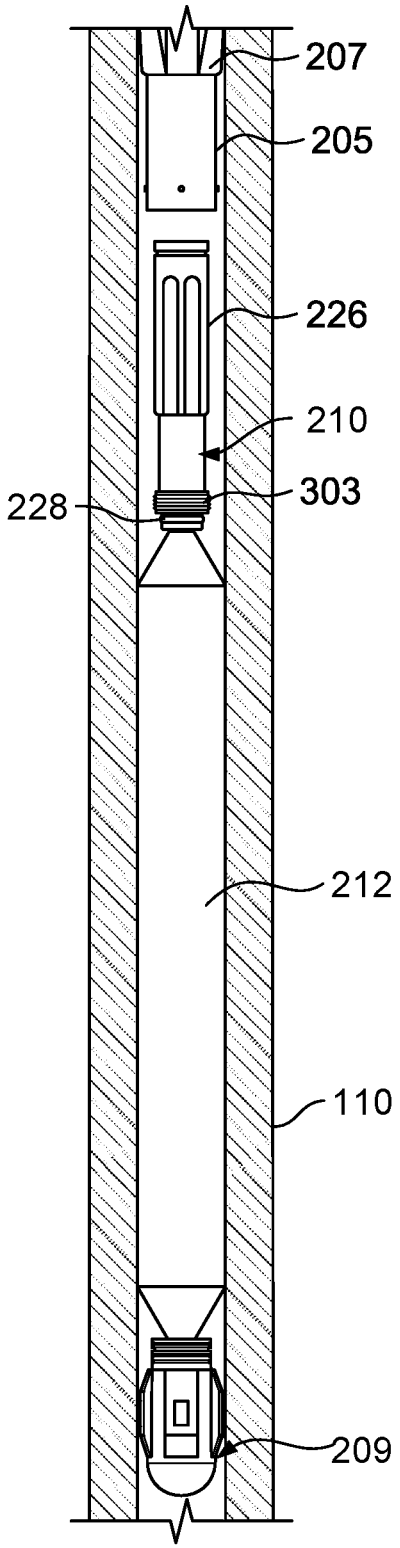

In this example, as shown in FIG. 7F, the disengagement ring 303 and the top liner anchor 210 can include castellations (or any other feature which will allow two parts to socket together and transmit torque). The downhole conveyance 120 (in this example, a drill string) can be rotated such that the disengagement ring 303 unscrews from the housing 205. The disengagement ring 303, float housing 224, float 226, and the top liner anchor 210 can then be released from the housing 205 as shown in FIG. 7F. In some aspects, the float 226 can prevent (or help prevent) any resin 130 that is inside the liner 212 from flowing back uphole (for example, by maintaining a positive pressure) after the liner 212 is released from the remaining portion of the tool 200. The end result of the deployment operation is also shown in FIG. 1D, as well as FIG. 7G (which shows a non-sectional view of the tool 200).

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

A number of implementations have been described. Nevertheless, it will be understood that various modifications may be made without departing from the spirit and scope of the disclosure. For example, example operations, methods, or processes described in this disclosure may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole liner delivery tool, comprising:

a housing configured to couple to a tubular work string, the housing comprising a flow path;

a detachable nose assembly coupled to a downhole end of the housing and fluidly coupled to the flow path, the detachable nose assembly comprising one or more retractable grips positioned at an external surface of the detachable nose assembly;

a flexible wellbore liner comprising a first end coupled to the detachable nose assembly and a second end coupled within the housing, the flexible wellbore liner stored within the flow path of the housing;

a seat formed in the flow path and configured to receive a member dropped in a wellbore from a terranean surface to increase a fluid pressure of a fluid resin pumped through the flow path to anchor the one or more retractable grips to a wellbore wall and detach the detachable nose assembly from the housing, the fluid resin further pumped through the flow path to deploy the flexible wellbore liner from the housing and seal the flexible wellbore liner against the wellbore wall; and a flow crossover sub-assembly positioned in the housing and comprising one or more ports fluidly coupled to the wellbore through the housing in a first position of the flow crossover sub-assembly to circulate the fluid resin from the flow path to the wellbore, the flow crossover sub-assembly configured to move from the first position to a second position based on breaking one or more shear pins that couples the flow crossover sub-assembly to the housing by the fluid pressure to fluidly decouple the one or more ports from the wellbore to circulate the fluid resin to anchor the one or more retractable grips to the wellbore wall.

2. The downhole liner delivery tool of claim 1, wherein the housing comprises an index pin positioned to ride in a groove formed on an outer surface of the flow crossover sub-assembly during movement of the flow crossover sub-assembly from the first position to the second position, the groove comprising a slot formed to stop movement of the flow crossover sub-assembly at the second position and maintain the flow crossover sub- assembly at the second position.

3. The downhole liner delivery tool of claim 1, further comprising a top liner anchor positioned within the housing and connected to the second end of the flexible wellbore liner, the top liner anchor configured to release the second end of the flexible wellbore liner subsequent to sealing the flexible wellbore liner against the wellbore.

4. The downhole liner delivery tool of claim 3, further comprising a float housing coupled to the top liner anchor and moveable, based on an uphole movement of the tubular work string, within the housing to deploy the flexible wellbore liner from the housing.

5. The downhole liner delivery tool of claim 4, wherein the top liner anchor is configured to socket into a disengagement ring within the housing to direct the fluid resin pumped through the flow path to an inner volume of the deployed flexible wellbore liner.

6. The downhole liner delivery tool of claim 5, wherein the float housing comprises a float configured to seal fluid resin within the inner volume of the deployed flexible wellbore liner.

7. The downhole liner delivery tool of claim 6, wherein the top liner anchor, the float housing, the disengagement ring, and the float are configured to detach from the housing based on rotation of the tubular work string.

8. The downhole liner delivery tool of claim 1, wherein the detachable nose assembly comprises a nose body that encloses a shuttle and a snap ring that at least partially encircles an end of the shuttle, the shuttle configured to move within the nose body based on the fluid pressure to urge the snap ring into a groove formed on an inner surface of the nose body to hold the one or more retractable grips anchored to the wellbore wall.

9. The downhole liner delivery tool of claim 1, further comprising at least one stabilizer mounted on an outer surface of the housing and configured to centralize the housing in the wellbore.

10. The downhole liner delivery tool of claim 1, wherein the fluid resin comprising a hardenable or semi-hardenable liquid configured to cure and attach the flexible wellbore liner to the wellbore wall.

11. A method for installing a liner in a wellbore, comprising:

running a downhole liner delivery tool on a tubular work string into a wellbore to a particular position adjacent a subterranean formation, the downhole liner delivery tool comprising:

a housing coupled to the tubular work string, the housing comprising a flow path, a detachable nose assembly coupled to a downhole end of the housing and fluidly coupled to the flow path, the detachable nose assembly comprising one or more retractable grips positioned at an external surface of the detachable nose assembly, and a flexible wellbore liner comprising a first end coupled to the detachable nose assembly and a second end coupled within the housing, the flexible wellbore liner stored within the flow path of the housing;

circulating a fluid resin at a fluid pressure from the terranean surface, into the tubular work string, and into the flow path;

dropping a member within the fluid resin to land on a seat formed in the flow path to increase the fluid pressure of the fluid resin pumped through the flow path;

based on the increased fluid pressure, anchoring the one or more retractable grips to a wellbore wall and detaching the detachable nose assembly from the housing;

further circulating the fluid resin through the flow path to deploy the flexible wellbore liner from the housing and seal the flexible wellbore liner against the wellbore wall;

circulating the fluid resin through one or more ports of a flow crossover sub-assembly positioned in the housing and into the wellbore through the housing while the flow crossover sub-assembly is in a first position;

based on the fluid pressure, breaking one or more shear pins that couples the flow crossover sub-assembly to the housing to move the flow crossover sub-assembly from the first position to a second position to fluidly decouple the one or more ports from the wellbore; and with the flow crossover sub-assembly in the second position, circulating the fluid resin to anchor the one or more retractable grips to the wellbore wall.

12. The method of claim 11, wherein the housing comprises an index pin, the method further comprising:

during movement of the flow crossover sub-assembly from the first position to the second position, causing the flow crossover sub-assembly to rotate based on the index pin riding in a groove formed on an outer surface of the flow crossover sub-assembly;

stopping rotation and movement of the flow crossover sub-assembly in the second position based on the index pin positioned in a slot formed in the groove; and maintaining the flow crossover sub-assembly at the second position based on the index pin positioned in the slot formed in the groove.

13. The method of claim 11, further comprising releasing the second end of the flexible wellbore liner from a top liner anchor positioned within the housing subsequent to sealing the flexible wellbore liner against the wellbore.

14. The method of claim 13, further comprising:

moving the tubular work string uphole; and based on moving the tubular work string uphole, moving a float housing coupled to the top liner anchor within the housing to deploy the flexible wellbore liner from the housing.

15. The method of claim 14, wherein the top liner anchor is configured to socket into a disengagement ring within the housing to direct the fluid resin pumped through the flow path to an inner volume of the deployed flexible wellbore liner.

16. The method of claim 15, further comprising sealing fluid resin within the inner volume of the deployed flexible wellbore liner with a float coupled to the float housing.

17. The method of claim 16, further comprising:

rotating the tubular work string; and based on the rotation, detaching the top liner anchor, the float housing, the disengagement ring, and the float from the housing.

18. The method of claim 11, wherein the detachable nose assembly comprises a nose body that encloses a shuttle and a snap ring that at least partially encircles an end of the shuttle, the method further comprising:

moving the shuttle within the nose body based on the fluid pressure to urge the snap ring into a groove formed on an inner surface of the nose body; and with the snap ring in the groove, holding the one or more retractable grips anchored to the wellbore wall.

19. The method of claim 11, further comprising, during movement of the downhole liner delivery tool on the tubular work string within the wellbore, centralizing the housing in the wellbore with at least one stabilizer mounted on an outer surface of the housing.

20. The method of claim 11, wherein the fluid resin comprises a hardenable or semi-hardenable liquid, and the method further comprises curing and attaching the flexible wellbore liner to the wellbore wall with the fluid resin.

21. A downhole liner delivery tool, comprising:

a housing configured to couple to a tubular work string, the housing comprising a flow path;

a detachable nose assembly coupled to a downhole end of the housing and fluidly coupled to the flow path, the detachable nose assembly comprising one or more retractable grips positioned at an external surface of the detachable nose assembly;

a flexible wellbore liner comprising a first end coupled to the detachable nose assembly and a second end coupled within the housing, the flexible wellbore liner stored within the flow path of the housing;

a seat formed in the flow path and configured to receive a member dropped in a wellbore from a terranean surface to increase a fluid pressure of a fluid resin pumped through the flow path to anchor the one or more retractable grips to a wellbore wall and detach the detachable nose assembly from the housing, the fluid resin further pumped through the flow path to deploy the flexible wellbore liner from the housing and seal the flexible wellbore liner against the wellbore wall;

a top liner anchor positioned within the housing and connected to the second end of the flexible wellbore liner, the top liner anchor configured to release the second end of the flexible wellbore liner subsequent to sealing the flexible wellbore liner against the wellbore; and a float housing coupled to the top liner anchor and moveable, based on an uphole movement of the tubular work string, within the housing to deploy the flexible wellbore liner from the housing.

22. A downhole liner delivery tool, comprising:

a housing configured to couple to a tubular work string, the housing comprising a flow path;

a detachable nose assembly coupled to a downhole end of the housing and fluidly coupled to the flow path, the detachable nose assembly comprising one or more retractable grips positioned at an external surface of the detachable nose assembly;

a flexible wellbore liner comprising a first end coupled to the detachable nose assembly and a second end coupled within the housing, the flexible wellbore liner stored within the flow path of the housing; and a seat formed in the flow path and configured to receive a member dropped in a wellbore from a terranean surface to increase a fluid pressure of a fluid resin pumped through the flow path to anchor the one or more retractable grips to a wellbore wall and detach the detachable nose assembly from the housing, the fluid resin further pumped through the flow path to deploy the flexible wellbore liner from the housing and seal the flexible wellbore liner against the wellbore wall, wherein the detachable nose assembly comprises a nose body that encloses a shuttle and a snap ring that at least partially encircles an end of the shuttle, the shuttle configured to move within the nose body based on the fluid pressure to urge the snap ring into a groove formed on an inner surface of the nose body to hold the one or more retractable grips anchored to the wellbore wall.

23. A method for installing a liner in a wellbore, comprising:

running a downhole liner delivery tool on a tubular work string into a wellbore to a particular position adjacent a subterranean formation, the downhole liner delivery tool comprising:

a housing coupled to the tubular work string, the housing comprising a flow path, a detachable nose assembly coupled to a downhole end of the housing and fluidly coupled to the flow path, the detachable nose assembly comprising one or more retractable grips positioned at an external surface of the detachable nose assembly, and a flexible wellbore liner comprising a first end coupled to the detachable nose assembly and a second end coupled within the housing, the flexible wellbore liner stored within the flow path of the housing;

circulating a fluid resin at a fluid pressure from the terranean surface, into the tubular work string, and into the flow path;

dropping a member within the fluid resin to land on a seat formed in the flow path to increase the fluid pressure of the fluid resin pumped through the flow path;

based on the increased fluid pressure, anchoring the one or more retractable grips to a wellbore wall and detaching the detachable nose assembly from the housing;

further circulating the fluid resin through the flow path to deploy the flexible wellbore liner from the housing and seal the flexible wellbore liner against the wellbore wall;

releasing the second end of the flexible wellbore liner from a top liner anchor positioned within the housing subsequent to sealing the flexible wellbore liner against the wellbore moving the tubular work string uphole; and based on moving the tubular work string uphole, moving a float housing coupled to the top liner anchor within the housing to deploy the flexible wellbore liner from the housing.

24. A method for installing a liner in a wellbore, comprising:

running a downhole liner delivery tool on a tubular work string into a wellbore to a particular position adjacent a subterranean formation, the downhole liner delivery tool comprising:

a housing coupled to the tubular work string, the housing comprising a flow path, a detachable nose assembly coupled to a downhole end of the housing and fluidly coupled to the flow path, the detachable nose assembly comprising one or more retractable grips positioned at an external surface of the detachable nose assembly, the detachable nose assembly further comprising a nose body that encloses a shuttle and a snap ring that at least partially encircles an end of the shuttle, and a flexible wellbore liner comprising a first end coupled to the detachable nose assembly and a second end coupled within the housing, the flexible wellbore liner stored within the flow path of the housing;

circulating a fluid resin at a fluid pressure from the terranean surface, into the tubular work string, and into the flow path;

dropping a member within the fluid resin to land on a seat formed in the flow path to increase the fluid pressure of the fluid resin pumped through the flow path;

based on the increased fluid pressure, anchoring the one or more retractable grips to a wellbore wall and detaching the detachable nose assembly from the housing;

further circulating the fluid resin through the flow path to deploy the flexible wellbore liner from the housing and seal the flexible wellbore liner against the wellbore wall;

moving the shuttle within the nose body based on the fluid pressure to urge the snap ring into a groove formed on an inner surface of the nose body; and with the snap ring in the groove, holding the one or more retractable grips anchored to the wellbore wall.

* * * * *